US011089428B2

(12) United States Patent
Salehin et al.

(10) Patent No.: US 11,089,428 B2
(45) Date of Patent: Aug. 10, 2021

(54) SELECTING AUDIO STREAMS BASED ON MOTION

(71) Applicant: QUALCOMM Incorporated, San Diego, CA (US)

(72) Inventors: S M Akramus Salehin, San Diego, CA (US); Siddhartha Goutham Swaminathan, San Diego, CA (US); Dipanjan Sen, Dublin, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/714,150

(22) Filed: Dec. 13, 2019

(65) Prior Publication Data

US 2021/0185470 A1 Jun. 17, 2021

(51) Int. Cl.

| | |
|---|---|
| ***H04S 7/00*** | (2006.01) |
| ***H04S 3/00*** | (2006.01) |
| ***H04R 5/04*** | (2006.01) |
| ***H04R 5/033*** | (2006.01) |

(52) U.S. Cl.

CPC ..... *H04S 7/304* (2013.01); *H04R 5/033* (2013.01); *H04R 5/04* (2013.01); *H04S 3/008* (2013.01); *H04S 2400/01* (2013.01); *H04S 2400/11* (2013.01)

(58) Field of Classification Search

None

See application file for complete search history.

(56) References Cited

U.S. PATENT DOCUMENTS

| | | | |
|---|---|---|---|
| 9,237,398 | B1 | 1/2016 | Algazi et al. |
| 10,405,126 | B2 | 9/2019 | Peters et al. |
| 2004/0076301 | A1 | 4/2004 | Algazi et al. |
| 2011/0249821 | A1 | 10/2011 | Jaillet et al. |
| 2018/0046431 | A1 | 2/2018 | Thagadur Shivappa et al. |
| 2018/0190300 | A1 | 7/2018 | Mate et al. |

(Continued)

FOREIGN PATENT DOCUMENTS

| | | | |
|---|---|---|---|
| WO | 2014001478 | A1 | 1/2014 |
| WO | 2018064528 | A1 | 4/2018 |

OTHER PUBLICATIONS

"Call for Proposals for 3D Audio," ISO/IEC JTC1/SC29/WG11/N13411, Jan. 2013, 20 Pages.

(Continued)

*Primary Examiner* — Kenny H Truong

(74) *Attorney, Agent, or Firm* — Shumaker & Sieffert, P.A.

(57) ABSTRACT

In general, various aspects of the techniques are described for selecting audio streams based on motion. A device comprising a processor and a memory may be configured to perform the techniques. The processor may be configured to obtain a current location of the device, and obtain capture locations. Each of the capture locations may identify a location at which a respective one of audio streams is captured. The processor may also be configured to select, based on the current location and the capture locations, a subset of the audio streams, where the subset of the audio streams have less audio streams than the audio streams. The processor may further be configured to reproduce, based on the subset of the audio streams, a soundfield. The memory may be configured to store the subset of the plurality of audio streams.

20 Claims, 19 Drawing Sheets

(56) References Cited

U.S. PATENT DOCUMENTS

| | | | | |
|---|---|---|---|---|
| 2018/0338213 | A1 | 11/2018 | Lehtiniemi et al. | |
| 2019/0306651 | A1* | 10/2019 | Vilermo | G06F 3/012 |
| 2019/0335292 | A1* | 10/2019 | Leppanen | G06F 3/165 |
| 2020/0029164 | A1 | 1/2020 | Swaminathan et al. | |

OTHER PUBLICATIONS

ETSI TS 103 589 V1.1.1, "Higher Order Ambisonics (HOA) Transport Format", Jun. 2018, 33 Pages.

Herre J., et al., "MPEG-H 3D Audio—The New Standard for Coding of Immersive Spatial Audio," IEEE Journal of Selected Topics in Signal Processing, Aug. 1, 2015 (Aug. 1, 2015), vol. 9(5), pp. 770-779, XP055243182, US ISSN: 1932-4553, DOI: 10.1109/JSTSP.2015.2411578.

Hollerweger F., "An Introduction to Higher Order Ambisonic," Oct. 2008, 13 Pages, Accessed online [Jul. 8, 2013] at <URL: flo.mur.at/writings/HOA-intro.pdf>.

"Information technology—High Efficiency Coding and Media Delivery in Heterogeneous Environments—Part 3: 3D Audio," ISO/IEC JTC 1/SC 29/WG11, ISO/IEC 23008-3, 201x(E), Oct. 12, 2016, 797 Pages.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 Pages.

ISO/IEC DIS 23008-3 Information Technology—High Efficiency coding and media delivery in heterogeneous environments—Part 3: 3D audio, Jul. 25, 2014 (Jul. 25, 2014), XP055205625, Retrieved from the Internet URL: http://mpeg.chiariglione.org/standards/mpeg-h/3d-audio/dis-mpeg-h-3d-audio [retrieved on Jul. 30, 2015], 433 Pages.

ISO/IEC/JTC: "ISO/IEC JTC 1/SC 29 N ISO/IEC CD 23008-3 Information technology—High efficiency coding and media delivery in heterogeneous environments—Part 3: 3D audio," Apr. 4, 2014 (Apr. 4, 2014), XP055206371, Retrieved from the Internet: URL:http://www.iso.org/iso/iso_catalogue/catalogue_tc/catalogue_tc_browse_htm?commmid=45316 [retrieved on Aug. 5, 2015] 338 Pages.

Peterson J., et al., "Virtual Reality, Augmented Reality, and Mixed Reality Definitions," EMA, version 1.0, Jul. 7, 2017, 4 pages.

Poetti M.A., "Three-Dimensional Surround Sound Systems Based on Spherical Harmonics", The Journal of the Audio Engineering Society, vol. 53, No. 11, Nov. 2005, pp. 1004-1025.

Prosecution History for U.S. Appl. No. 16/513,436 dated from Jul. 16, 2019, 148 Pages.

Schonefeld V., "Spherical Harmonics," Jul. 1, 2005, XP002599101, 25 Pages, Accessed online [Jul. 9, 2013] at URL:http://heim.c-otto.de/~volker/prosem_paper_pdf.

Sen D., et al., "RM1-HOA Working Draft Text", 107. MPEG Meeting; Jan. 13-17, 2014; San Jose; (Motion Picture Expert Group or ISO/IEC JTC1/SC29/WG11), No. m31827, Jan. 11, 2014 (Jan. 11, 2014), 83 Pages, XP030060280.

Sen D., et al., "Technical Description of the Qualcomm's HoA Coding Technology for Phase II", 109. MPEG Meeting; Jul. 7-Nov. 7, 2014; Sapporo; (Motion Picture Expert Group or ISO/IEC JTC1/SC29/WG11), No. m34104, Jul. 2, 2014 (Jul. 2, 2014), 4 Pages, XP030062477, figure 1.

WG11: "Proposed Draft 1.0 of TR: Technical Report on Architectures for Immersive Media", ISO/IEC JTC1/SC29/WG11/N17685, San Diego, US, Apr. 2018, 14 Pages.

International Search Report and Written Opinion—PCT/US2020/064611—ISA/EPO—dated Feb. 18, 2021.

* cited by examiner

SELECTING AUDIO STREAMS BASED ON MOTION

TECHNICAL FIELD

This disclosure relates to processing of audio data.

BACKGROUND

Computer-mediated reality systems are being developed to allow computing devices to augment or add to, remove or subtract from, or generally modify existing reality experienced by a user. Computer-mediated reality systems (which may also be referred to as "extended reality systems," or "XR systems") may include, as examples, virtual reality (VR) systems, augmented reality (AR) systems, and mixed reality (MR) systems. The perceived success of computer-mediated reality systems are generally related to the ability of such computer-mediated reality systems to provide a realistically immersive experience in terms of both the video and audio experience where the video and audio experience align in ways expected by the user. Although the human visual system is more sensitive than the human auditory systems (e.g., in terms of perceived localization of various objects within the scene), ensuring an adequate auditory experience is an increasingly import factor in ensuring a realistically immersive experience, particularly as the video experience improves to permit better localization of video objects that enable the user to better identify sources of audio content.

SUMMARY

This disclosure generally relates to techniques for selecting an audio stream from one or more existing audio streams based on user motion. The techniques may improve the listener experience, while also reducing soundfield reproduction localization errors, as the selected audio stream may better reflect a location of a listener relative to the existing audio streams, thereby improving the operation of a playback device (that performs the techniques to reproduce the soundfield) itself.

In one example, the techniques are directed to a device configured to process one or more audio streams, the device comprising: one or more processors configured to: obtain a current location of the device; obtain a plurality of capture locations, each of the plurality of capture locations identifying a location at which a respective one of a plurality of audio streams is captured; select, based on the current location and the plurality of capture locations, a subset of the plurality of audio streams, the subset of the plurality of audio streams having less audio streams than the plurality of audio streams; and reproduce, based on the subset of the plurality of audio streams, a soundfield; and a memory coupled to the processor, and configured to store the subset of the plurality of audio streams.

In another example, the techniques are directed to a method of processing one or more audio streams, the method comprising: obtaining a current location of a device; obtaining a plurality of capture locations, each of the plurality of capture locations identifying a location at which a respective one of a plurality of audio streams is captured; selecting, based on the current location and the plurality of capture locations, a subset of the plurality of audio streams, the subset of the plurality of audio streams having less audio streams than the plurality of audio streams; and reproducing, based on the subset of the plurality of audio streams, a soundfield.

In another example, the techniques are directed to a non-transitory computer-readable storage medium having stored thereon instructions that, when executed, cause one or more processors of a device to: obtain a current location of the device; obtain a plurality of capture locations, each of the plurality of capture locations identifying a location at which a respective one of a plurality of audio streams is captured; select, based on the current location and the plurality of capture locations, a subset of the plurality of audio streams, the subset of the plurality of audio streams having less audio streams than the plurality of audio streams; and reproduce, based on the subset of the plurality of audio streams, a soundfield.

In another example, the techniques are directed to a device configured to process one or more audio streams, the device comprising: means for obtaining a current location of a device; means for obtaining a plurality of capture locations, each of the plurality of capture locations identifying a location at which a respective one of a plurality of audio streams is captured; means for selecting, based on the current location and the plurality of capture locations, a subset of the plurality of audio streams, the subset of the plurality of audio streams having less audio streams than the plurality of audio streams; and means for reproducing, based on the subset of the plurality of audio streams, a soundfield.

The details of one or more examples of this disclosure are set forth in the accompanying drawings and the description below. Other features, objects, and advantages of various aspects of the techniques will be apparent from the description and drawings, and from the claims.

DETAILED DESCRIPTION

Figure 1A:
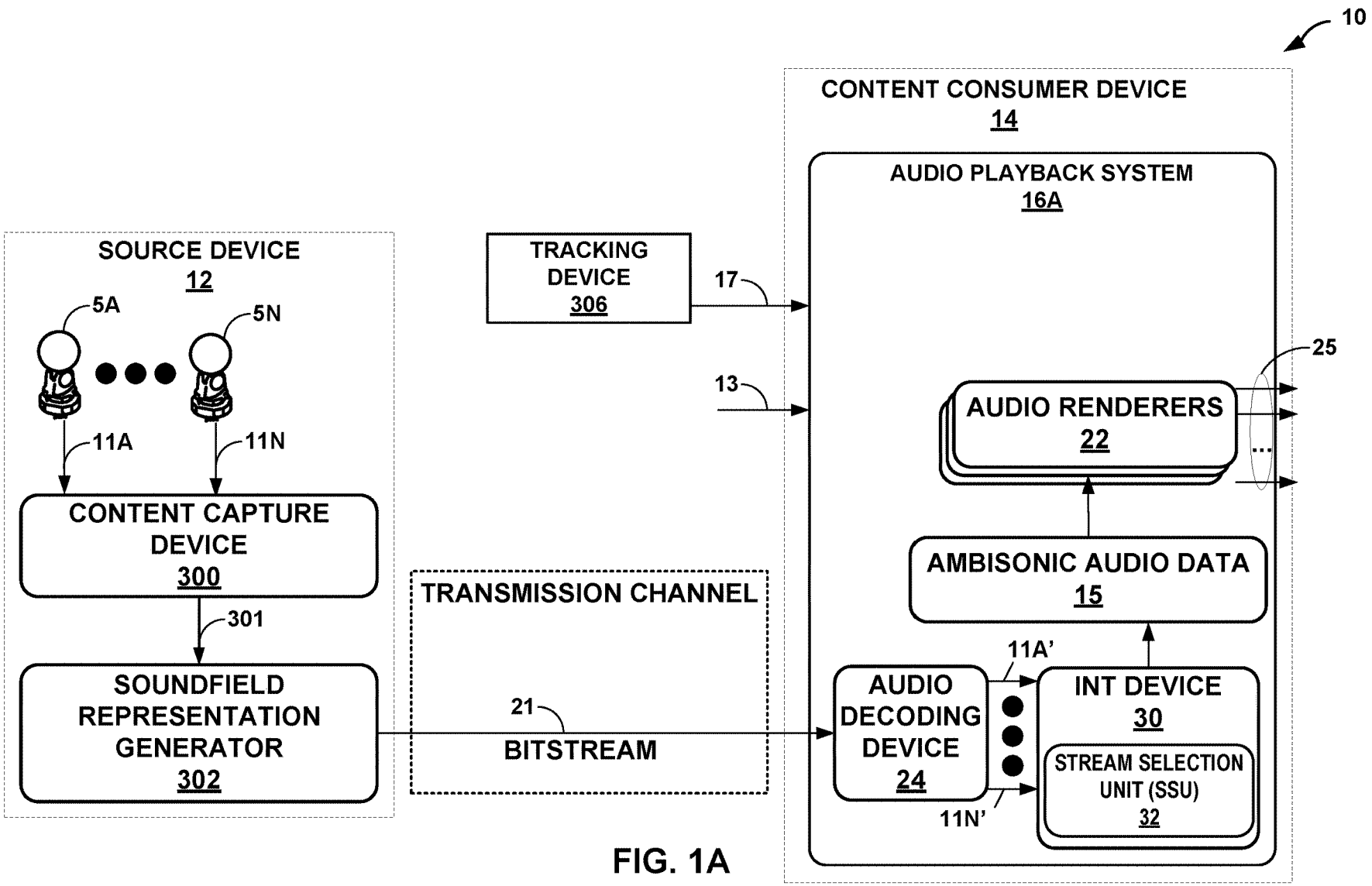
FIGS. 1A and 1B are diagrams illustrating systems that may perform various aspects of the techniques described in this disclosure.

There are a number of different ways to represent a soundfield. Example formats include channel-based audio formats, object-based audio formats, and scene-based audio formats. Channel-based audio formats refer to the 5.1 surround sound format, 7.1 surround sound formats, 22.2 surround sound formats, or any other channel-based format that localizes audio channels to particular locations around the listener in order to recreate a soundfield.

Object-based audio formats may refer to formats in which audio objects, often encoded using pulse-code modulation (PCM) and referred to as PCM audio objects, are specified in order to represent the soundfield. Such audio objects may include metadata identifying a location of the audio object relative to a listener or other point of reference in the soundfield, such that the audio object may be rendered to one or more speaker channels for playback in an effort to recreate the soundfield. The techniques described in this disclosure may apply to any of the foregoing formats, including scene-based audio formats, channel-based audio formats, object-based audio formats, or any combination thereof.

Scene-based audio formats may include a hierarchical set of elements that define the soundfield in three dimensions. One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

The SHC $A_n^m(k)$ can either be physically acquired (e.g., recorded) by various microphone array configurations or, alternatively, they can be derived from channel-based or object-based descriptions of the soundfield. The SHC (which also may be referred to as ambisonic coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be physically acquired from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

The following equation may illustrate how the SHCs may be derived from an object-based description. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the pulse code modulated—PCM—stream) may enable conversion of each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). The coefficients may contain information about the soundfield (the pressure as a function of 3D coordinates), and the above represents the transformation from individual objects to a representation of the overall soundfield, in the vicinity of the observation point $\{r_r, \theta_r, \varphi_r\}$.

Computer-mediated reality systems (which may also be referred to as "extended reality systems," or "XR systems") are being developed to take advantage of many of the potential benefits provided by ambisonic coefficients. For example, ambisonic coefficients may represent a soundfield in three dimensions in a manner that potentially enables accurate three-dimensional (3D) localization of sound sources within the soundfield. As such, XR devices may render the ambisonic coefficients to speaker feeds that, when played via one or more speakers, accurately reproduce the soundfield.

The use of ambisonic coefficients for XR may enable development of a number of use cases that rely on the more immersive soundfields provided by the ambisonic coefficients, particularly for computer gaming applications and live video streaming applications. In these highly dynamic use cases that rely on low latency reproduction of the soundfield, the XR devices may prefer ambisonic coefficients over other representations that are more difficult to manipulate or involve complex rendering. More information regarding these use cases is provided below with respect to FIGS. 1A and 1B.

While described in this disclosure with respect to the VR device, various aspects of the techniques may be performed in the context of other devices, such as a mobile device. In this instance, the mobile device (such as a so-called smartphone) may present the displayed world via a screen, which may be mounted to the head of the user 102 or viewed as would be done when normally using the mobile device. As such, any information on the screen can be part of the mobile device. The mobile device may be able to provide tracking information 41 and thereby allow for both a VR experience (when head mounted) and a normal experience to view the displayed world, where the normal experience may still allow the user to view the displayed world proving a VR-lite-type experience (e.g., holding up the device and rotating or translating the device to view different portions of the displayed world).

Figure 1B:
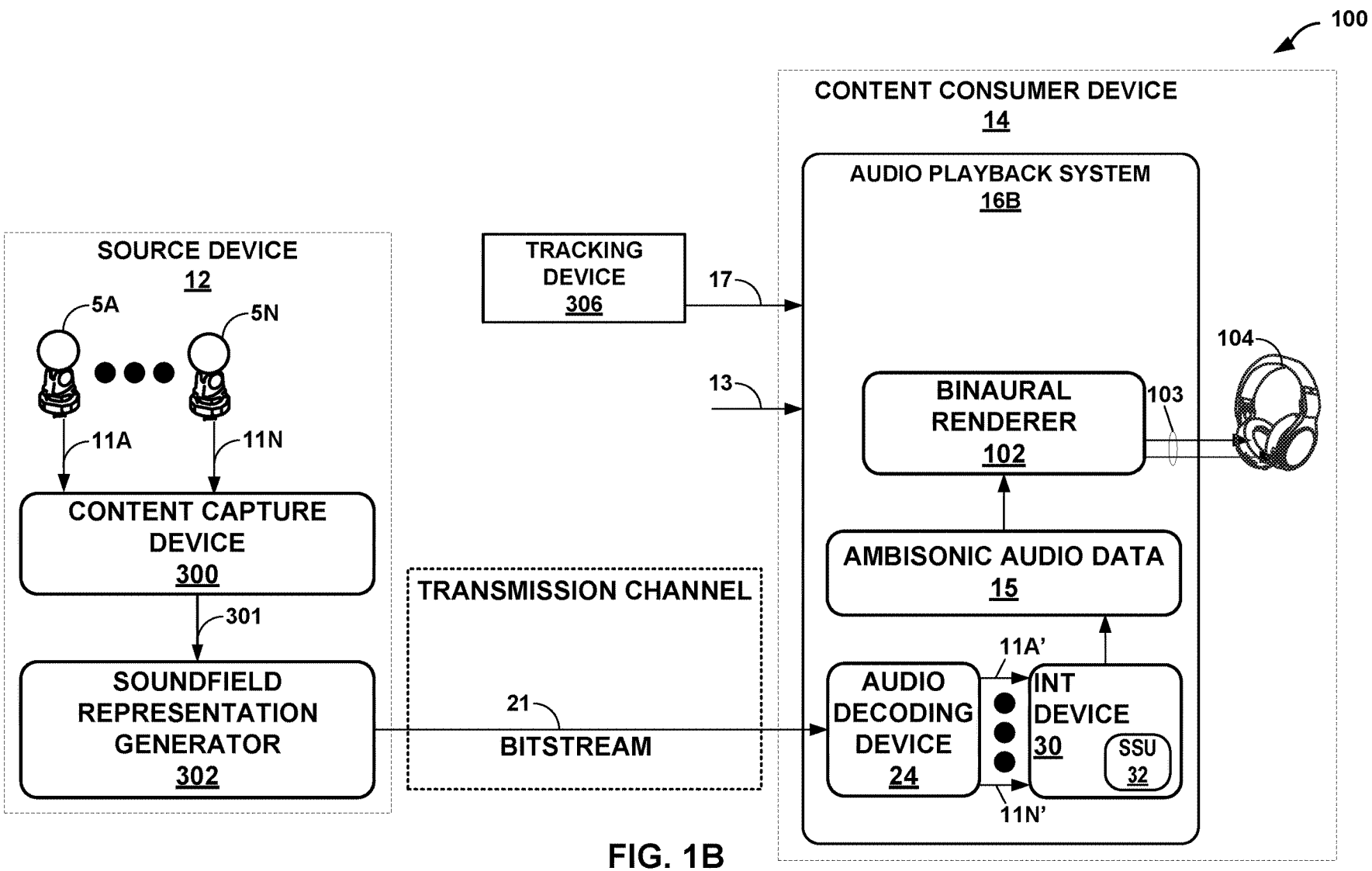

FIGS. 1A and 1B are diagrams illustrating systems that may perform various aspects of the techniques described in this disclosure. As shown in the example of FIG. 1A, system 10 includes a source device 12 and a content consumer device 14. While described in the context of the source device 12 and the content consumer device 14, the techniques may be implemented in any context in which any hierarchical representation of a soundfield is encoded to form a bitstream representative of the audio data. Moreover, the source device 12 may represent any form of computing device capable of generating hierarchical representation of a soundfield, and is generally described herein in the context of being a VR content creator device. Likewise, the content consumer device 14 may represent any form of computing device capable of implementing the audio stream interpolation techniques described in this disclosure as well as audio playback, and is generally described herein in the context of being a VR client device.

The source device 12 may be operated by an entertainment company or other entity that may generate multichannel audio content for consumption by operators of content consumer devices, such as the content consumer device 14. In many VR scenarios, the source device 12 generates audio content in conjunction with video content. The source device 12 includes a content capture device 300 and a content soundfield representation generator 302.

The content capture device 300 may be configured to interface or otherwise communicate with one or more microphones 5A-5N ("microphones 5"). The microphones 5 may represent an Eigenmike® or other type of 3D audio microphone capable of capturing and representing the soundfield as corresponding scene-based audio data 11A-11N (which may also be referred to as ambisonic coefficients 11A-11N or "ambisonic coefficients 11"). In the context of scene-based audio data 11 (which is another way to refer to the ambisonic coefficients 11"), each of the microphones 5 may represent a cluster of microphones arranged within a single housing according to set geometries that facilitate generation of the ambisonic coefficients 11. As such, the term microphone may refer to a cluster of microphones (which are actually geometrically arranged transducers) or a single microphone (which may be referred to as a spot microphone).

The ambisonic coefficients 11 may represent one example of an audio stream. As such, the ambisonic coefficients 11 may also be referred to as audio streams 11. Although described primarily with respect to the ambisonic coefficients 11, the techniques may be performed with respect to other types of audio streams, including pulse code modulated (PCM) audio streams, channel-based audio streams, object-based audio streams, etc.

The content capture device 300 may, in some examples, include an integrated microphone that is integrated into the housing of the content capture device 300. The content capture device 300 may interface wirelessly or via a wired connection with the microphones 5. Rather than capture, or in conjunction with capturing, audio data via the microphones 5, the content capture device 300 may process the ambisonic coefficients 11 after the ambisonic coefficients 11 are input via some type of removable storage, wirelessly, and/or via wired input processes, or alternatively or in conjunction with the foregoing, generated or otherwise created (from stored sound samples, such as is common in gaming applications, etc.). As such, various combinations of the content capture device 300 and the microphones 5 are possible.

The content capture device 300 may also be configured to interface or otherwise communicate with the soundfield representation generator 302. The soundfield representation generator 302 may include any type of hardware device capable of interfacing with the content capture device 300. The soundfield representation generator 302 may use the ambisonic coefficients 11 provided by the content capture device 300 to generate various representations of the same soundfield represented by the ambisonic coefficients 11.

For instance, to generate the different representations of the soundfield using ambisonic coefficients (which again is one example of the audio streams), the soundfield representation generator 24 may use a coding scheme for ambisonic representations of a soundfield, referred to as Mixed Order Ambisonics (MOA) as discussed in more detail in U.S. application Ser. No. 15/672,058, entitled "MIXED-ORDER AMBISONICS (MOA) AUDIO DATA FO COMPUTER-MEDIATED REALITY SYSTEMS," filed Aug. 8, 2017, and published as U.S. patent publication no. 20190007781 on Jan. 3, 2019.

To generate a particular MOA representation of the soundfield, the soundfield representation generator 24 may generate a partial subset of the full set of ambisonic coefficients. For instance, each MOA representation generated by the soundfield representation generator 24 may provide precision with respect to some areas of the soundfield, but less precision in other areas. In one example, an MOA representation of the soundfield may include eight (8) uncompressed ambisonic coefficients, while the third order ambisonic representation of the same soundfield may include sixteen (16) uncompressed ambisonic coefficients. As such, each MOA representation of the soundfield that is generated as a partial subset of the ambisonic coefficients may be less storage-intensive and less bandwidth intensive (if and when transmitted as part of the bitstream 27 over the illustrated transmission channel) than the corresponding third order ambisonic representation of the same soundfield generated from the ambisonic coefficients.

Although described with respect to MOA representations, the techniques of this disclosure may also be performed with respect to first-order ambisonic (FOA) representations in which all of the ambisonic coefficients associated with a first order spherical basis function and a zero order spherical basis function are used to represent the soundfield. In other words, rather than represent the soundfield using a partial, non-zero subset of the ambisonic coefficients, the soundfield representation generator 302 may represent the soundfield using all of the ambisonic coefficients for a given order N, resulting in a total of ambisonic coefficients equaling $(N+1)^2$.

In this respect, the ambisonic audio data (which is another way to refer to the ambisonic coefficients in either MOA representations or full order representations, such as the first-order representation noted above) may include ambisonic coefficients associated with spherical basis functions having an order of one or less (which may be referred to as "1st order ambisonic audio data"), ambisonic coefficients associated with spherical basis functions having a mixed order and suborder (which may be referred to as the "MOA representation" discussed above), or ambisonic coefficients associated with spherical basis functions having an order greater than one (which is referred to above as the "full order representation").

The content capture device 300 may, in some examples, be configured to wirelessly communicate with the soundfield representation generator 302. In some examples, the content capture device 300 may communicate, via one or both of a wireless connection or a wired connection, with the soundfield representation generator 302. Via the connection between the content capture device 300 and the soundfield representation generator 302, the content capture device 300 may provide content in various forms of content, which, for purposes of discussion, are described herein as being portions of the ambisonic coefficients 11.

In some examples, the content capture device 300 may leverage various aspects of the soundfield representation generator 302 (in terms of hardware or software capabilities of the soundfield representation generator 302). For example, the soundfield representation generator 302 may include dedicated hardware configured to (or specialized software that when executed causes one or more processors to) perform psychoacoustic audio encoding (such as a unified speech and audio coder denoted as "USAC" set forth by the Moving Picture Experts Group (MPEG), the MPEG-H 3D audio coding standard, the MPEG-I Immersive Audio standard, or proprietary standards, such as AptX™ (including various versions of AptX such as enhanced AptX—E-AptX, AptX live, AptX stereo, and AptX high definition—AptX-HD), advanced audio coding (AAC), Audio Codec 3 (AC-3), Apple Lossless Audio Codec (ALAC), MPEG-4 Audio Lossless Streaming (ALS), enhanced AC-3, Free Lossless Audio Codec (FLAC), Monkey's Audio, MPEG-1 Audio Layer II (MP2), MPEG-1 Audio Layer III (MP3), Opus, and Windows Media Audio (WMA).

The content capture device 300 may not include the psychoacoustic audio encoder dedicated hardware or specialized software and instead provide audio aspects of the content 301 in a non-psychoacoustic audio coded form. The soundfield representation generator 302 may assist in the capture of content 301 by, at least in part, performing psychoacoustic audio encoding with respect to the audio aspects of the content 301.

The soundfield representation generator 302 may also assist in content capture and transmission by generating one or more bitstreams 21 based, at least in part, on the audio content (e.g., MOA representations, third order ambisonic representations, and/or first order ambisonic representations) generated from the ambisonic coefficients 11. The bitstream 21 may represent a compressed version of the ambisonic coefficients 11 (and/or the partial subsets thereof used to form MOA representations of the soundfield) and any other different types of the content 301 (such as a compressed version of spherical video data, image data, or text data).

The soundfield representation generator 302 may generate the bitstream 21 for transmission, as one example, across a transmission channel, which may be a wired or wireless channel, a data storage device, or the like. The bitstream 21 may represent an encoded version of the ambisonic coefficients 11 (and/or the partial subsets thereof used to form MOA representations of the soundfield) and may include a primary bitstream and another side bitstream, which may be referred to as side channel information. In some instances, the bitstream 21 representing the compressed version of the ambisonic coefficients 11 may conform to bitstreams produced in accordance with the MPEG-H 3D audio coding standard.

The content consumer device 14 may be operated by an individual, and may represent a VR client device. Although described with respect to a VR client device, content consumer device 14 may represent other types of devices, such as an augmented reality (AR) client device, a mixed reality (MR) client device (or any other type of head-mounted display device or extended reality—XR—device), a standard computer, a headset, headphones, or any other device capable of tracking head movements and/or general translational movements of the individual operating the client consumer device 14. As shown in the example of FIG. 1A, the content consumer device 14 includes an audio playback system 16A, which may refer to any form of audio playback system capable of rendering ambisonic coefficients (whether in form of first order, second order, and/or third order ambisonic representations and/or MOA representations) for playback as multi-channel audio content.

The content consumer device 14 may retrieve the bitstream 21 directly from the source device 12. In some examples, the content consumer device 12 may interface with a network, including a fifth generation (5G) cellular network, to retrieve the bitstream 21 or otherwise cause the source device 12 to transmit the bitstream 21 to the content consumer device 14.

While shown in FIG. 1A as being directly transmitted to the content consumer device 14, the source device 12 may output the bitstream 21 to an intermediate device positioned between the source device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the source device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 1A.

As noted above, the content consumer device 14 includes the audio playback system 16. The audio playback system 16 may represent any system capable of playing back multi-channel audio data. The audio playback system 16A may include a number of different audio renderers 22. The renderers 22 may each provide for a different form of audio rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16A may further include an audio decoding device 24. The audio decoding device 24 may represent a device configured to decode bitstream 21 to output reconstructed ambisonic coefficients 11A'-11N' (which may form the full first, second, and/or third order ambisonic representation or a subset thereof that forms an MOA representation of the same soundfield or decompositions thereof, such as the predominant audio signal, ambient ambisonic coefficients, and the vector based signal described in the MPEG-H 3D Audio Coding Standard and/or the MPEG-I Immersive Audio standard).

As such, the ambisonic coefficients 11A'-11N' ("ambisonic coefficients 11") may be similar to a full set or a partial subset of the ambisonic coefficients 11, but may differ due to lossy operations (e.g., quantization) and/or transmission via the transmission channel. The audio playback system 16 may, after decoding the bitstream 21 to obtain the ambisonic coefficients 11', obtain ambisonic audio data 15 from the different streams of ambisonic coefficients 11', and render the ambisonic audio data 15 to output speaker feeds 25. The speaker feeds 25 may drive one or more speakers (which are not shown in the example of FIG. 1A for ease of illustration purposes). Ambisonic representations of a soundfield may be normalized in a number of ways, including N3D, SN3D, FuMa, N2D, or SN2D.

To select the appropriate renderer or, in some instances, generate an appropriate renderer, the audio playback system 16A may obtain loudspeaker information 13 indicative of a number of loudspeakers and/or a spatial geometry of the loudspeakers. In some instances, the audio playback system 16A may obtain the loudspeaker information 13 using a reference microphone and outputting a signal to activate (or, in other words, drive) the loudspeakers in such a manner as to dynamically determine, via the reference microphone, the loudspeaker information 13. In other instances, or in conjunction with the dynamic determination of the loudspeaker information 13, the audio playback system 16A may prompt a user to interface with the audio playback system 16A and input the loudspeaker information 13.

The audio playback system 16A may select one of the audio renderers 22 based on the loudspeaker information 13. In some instances, the audio playback system 16A may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16A may, in some instances, generate one of the audio renderers 22 based on the loudspeaker information 13 without first attempting to select an existing one of the audio renderers 22.

When outputting the speaker feeds 25 to headphones, the audio playback system 16A may utilize one of the renderers 22 that provides for binaural rendering using head-related transfer functions (HRTF) or other functions capable of rendering to left and right speaker feeds 25 for headphone speaker playback. The terms "speakers" or "transducer" may generally refer to any speaker, including loudspeakers, headphone speakers, etc. One or more speakers may then playback the rendered speaker feeds 25.

Although described as rendering the speaker feeds 25 from the ambisonic audio data 15, reference to rendering of the speaker feeds 25 may refer to other types of rendering, such as rendering incorporated directly into the decoding of the ambisonic audio data 15 from the bitstream 21. An example of the alternative rendering can be found in Annex G of the MPEG-H 3D audio coding standard, where rendering occurs during the predominant signal formulation and the background signal formation prior to composition of the soundfield. As such, reference to rendering of the ambisonic audio data 15 should be understood to refer to both rendering of the actual ambisonic audio data 15 or decompositions or representations thereof of the ambisonic audio data 15 (such as the above noted predominant audio signal, the ambient ambisonic coefficients, and/or the vector-based signal—which may also be referred to as a V-vector).

Figure 5A:
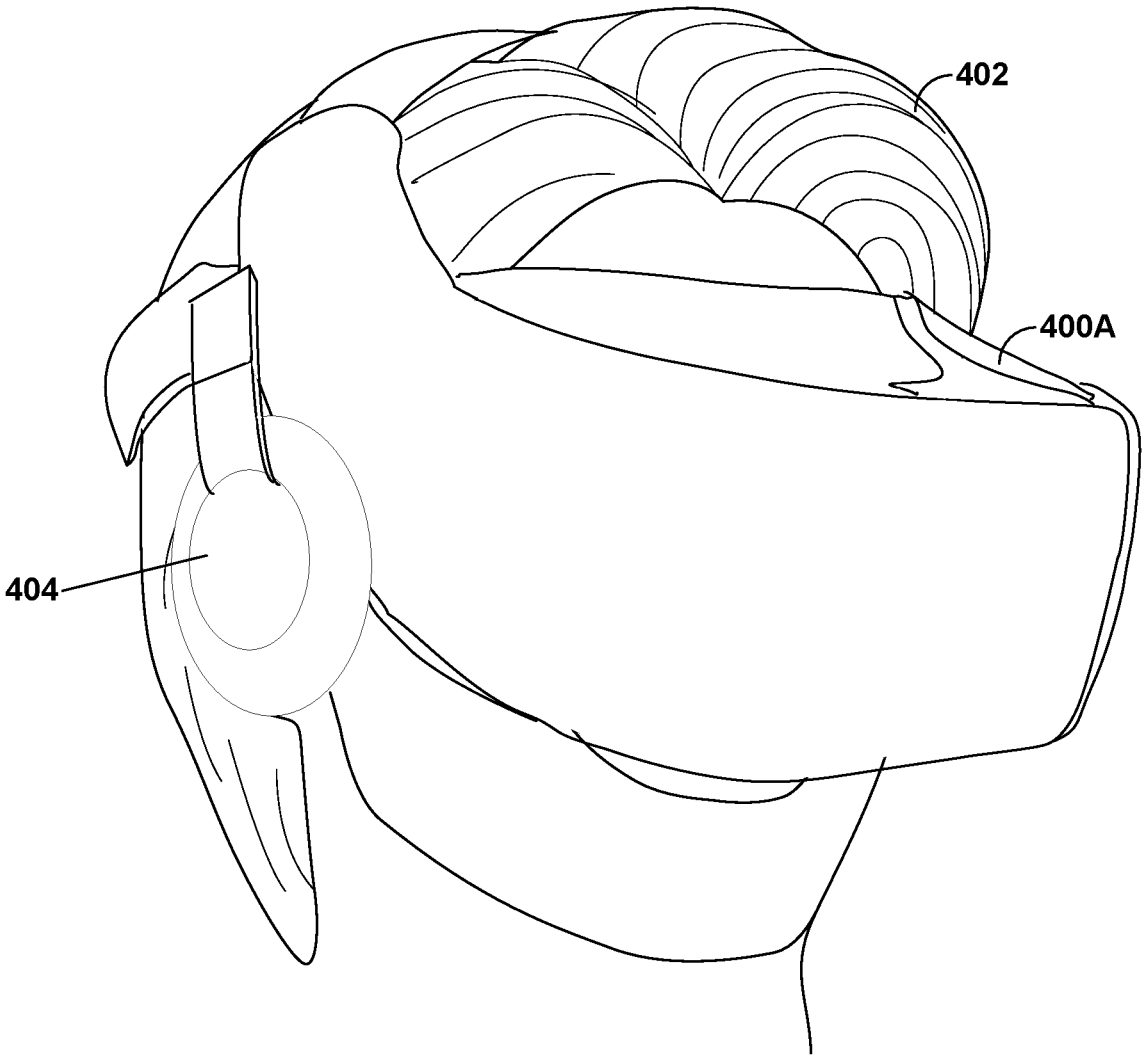
FIGS. 5A and 5B are diagrams illustrating examples of VR devices.
Figure 5B:
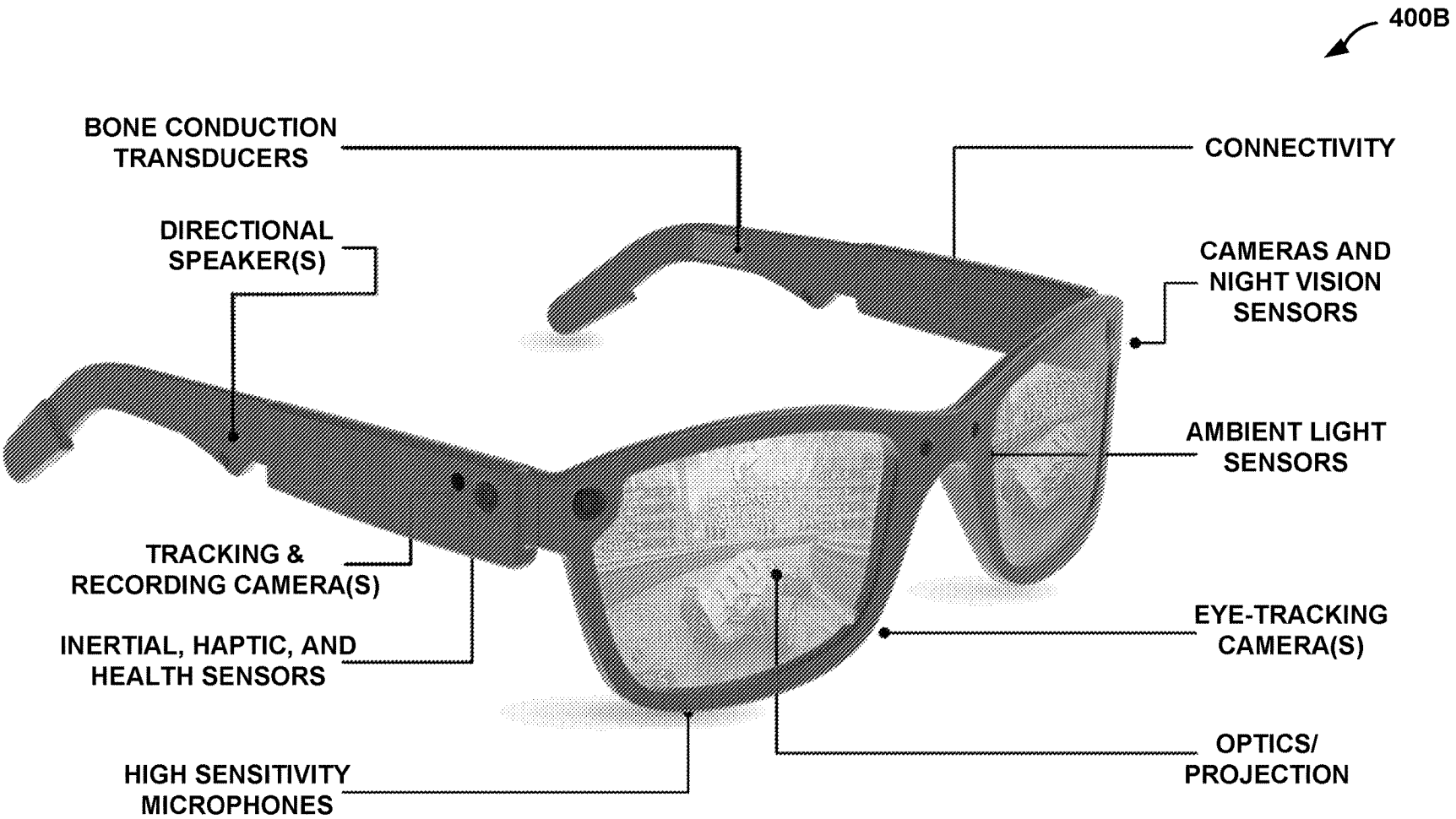

As described above, the content consumer device 14 may represent a VR device in which a human wearable display is mounted in front of the eyes of the user operating the VR device. FIGS. 5A and 5B are diagrams illustrating examples of VR devices 400A and 400B. In the example of FIG. 5A, the VR device 400A is coupled to, or otherwise includes, headphones 404, which may reproduce a soundfield represented by the ambisonic audio data 15 (which is another way to refer to ambisonic coefficients 15) through playback of the speaker feeds 25. The speaker feeds 25 may represent an analog or digital signal capable of causing a membrane within the transducers of headphones 404 to vibrate at various frequencies. Such a process is commonly referred to as driving the headphones 404.

Video, audio, and other sensory data may play important roles in the VR experience. To participate in a VR experience, a user 402 may wear the VR device 400A (which may also be referred to as a VR headset 400A) or other wearable electronic device. The VR client device (such as the VR headset 400A) may track head movement of the user 402, and adapt the video data shown via the VR headset 400A to account for the head movements, providing an immersive experience in which the user 402 may experience a virtual world shown in the video data in visual three dimensions.

While VR (and other forms of AR and/or MR, which may generally be referred to as a computer mediated reality device) may allow the user 402 to reside in the virtual world visually, often the VR headset 400A may lack the capability to place the user in the virtual world audibly. In other words, the VR system (which may include a computer responsible for rendering the video data and audio data—that is not shown in the example of FIG. 5A for ease of illustration purposes, and the VR headset 400A) may be unable to support full three dimension immersion audibly.

FIG. 5B is a diagram illustrating an example of a wearable device 400B that may operate in accordance with various aspect of the techniques described in this disclosure. In various examples, the wearable device 400B may represent a VR headset (such as the VR headset 400A described above), an AR headset, an MR headset, or any other type of XR headset. Augmented Reality "AR" may refer to computer rendered image or data that is overlaid over the real world where the user is actually located. Mixed Reality "MR" may refer to computer rendered image or data that is world locked to a particular location in the real world, or may refer to a variant on VR in which part computer rendered 3D elements and part photographed real elements are combined into an immersive experience that simulates the user's physical presence in the environment. Extended Reality "XR" may represent a catchall term for VR, AR, and MR. More information regarding terminology for XR can be found in a document by Jason Peterson, entitled "Virtual Reality, Augmented Reality, and Mixed Reality Definitions," and dated Jul. 7, 2017.

The wearable device 400B may represent other types of devices, such as a watch (including so-called "smart watches"), glasses (including so-called "smart glasses"), headphones (including so-called "wireless headphones" and "smart headphones"), smart clothing, smart jewelry, and the like. Whether representative of a VR device, a watch, glasses, and/or headphones, the wearable device 400B may communicate with the computing device supporting the wearable device 400B via a wired connection or a wireless connection.

In some instances, the computing device supporting the wearable device 400B may be integrated within the wearable device 400B and as such, the wearable device 400B may be considered as the same device as the computing device supporting the wearable device 400B. In other instances, the wearable device 400B may communicate with a separate computing device that may support the wearable device 400B. In this respect, the term "supporting" should not be understood to require a separate dedicated device but that one or more processors configured to perform various aspects of the techniques described in this disclosure may be integrated within the wearable device 400B or integrated within a computing device separate from the wearable device 400B.

For example, when the wearable device 400B represents an example of the VR device 400B, a separate dedicated computing device (such as a personal computer including the one or more processors) may render the audio and visual content, while the wearable device 400B may determine the translational head movement upon which the dedicated computing device may render, based on the translational head movement, the audio content (as the speaker feeds) in accordance with various aspects of the techniques described in this disclosure. As another example, when the wearable device 400B represents smart glasses, the wearable device 400B may include the one or more processors that both determine the translational head movement (by interfacing within one or more sensors of the wearable device 400B) and render, based on the determined translational head movement, the speaker feeds.

As shown, the wearable device 400B includes one or more directional speakers, and one or more tracking and/or recording cameras. In addition, the wearable device 400B includes one or more inertial, haptic, and/or health sensors, one or more eye-tracking cameras, one or more high sensitivity audio microphones, and optics/projection hardware. The optics/projection hardware of the wearable device 400B may include durable semi-transparent display technology and hardware.

The wearable device 400B also includes connectivity hardware, which may represent one or more network interfaces that support multimode connectivity, such as 4G communications, 5G communications, Bluetooth, etc. The wearable device 400B also includes one or more ambient light sensors, and bone conduction transducers. In some instances, the wearable device 400B may also include one or more passive and/or active cameras with fisheye lenses and/or telephoto lenses. Although not shown in FIG. 5B, the wearable device 400B also may include one or more light emitting diode (LED) lights. In some examples, the LED light(s) may be referred to as "ultra bright" LED light(s). The wearable device 400B also may include one or more rear cameras in some implementations. It will be appreciated that the wearable device 400B may exhibit a variety of different form factors.

Furthermore, the tracking and recording cameras and other sensors may facilitate the determination of translational distance. Although not shown in the example of FIG. 5B, wearable device 400B may include other types of sensors for detecting translational distance.

Although described with respect to particular examples of wearable devices, such as the VR device 400B discussed above with respect to the examples of FIG. 5B and other devices set forth in the examples of FIGS. 1A and 1B, a person of ordinary skill in the art would appreciate that descriptions related to FIGS. 1A-4B may apply to other examples of wearable devices. For example, other wearable devices, such as smart glasses, may include sensors by which to obtain translational head movements. As another example, other wearable devices, such as a smart watch, may include sensors by which to obtain translational movements. As such, the techniques described in this disclosure should not be limited to a particular type of wearable device, but any wearable device may be configured to perform the techniques described in this disclosure.

In any event, the audio aspects of VR have been classified into three separate categories of immersion. The first category provides the lowest level of immersion, and is referred to as three degrees of freedom (3DOF). 3DOF refers to audio rendering that accounts for movement of the head in the three degrees of freedom (yaw, pitch, and roll), thereby allowing the user to freely look around in any direction. 3DOF, however, cannot account for translational head movements in which the head is not centered on the optical and acoustical center of the soundfield.

The second category, referred to 3DOF plus (3DOF+), provides for the three degrees of freedom (yaw, pitch, and roll) in addition to limited spatial translational movements due to the head movements away from the optical center and acoustical center within the soundfield. 3DOF+ may provide support for perceptual effects such as motion parallax, which may strengthen the sense of immersion.

The third category, referred to as six degrees of freedom (6DOF), renders audio data in a manner that accounts for the three degrees of freedom in term of head movements (yaw, pitch, and roll) but also accounts for translation of the user in space (x, y, and z translations). The spatial translations may be induced by sensors tracking the location of the user in the physical world or by way of an input controller.

3DOF rendering is the current state of the art for audio aspects of VR. As such, the audio aspects of VR are less immersive than the video aspects, thereby potentially reducing the overall immersion experienced by the user, and introducing localization errors (e.g., such as when the auditory playback does not match or correlate exactly to the visual scene).

In accordance with the techniques described in this disclosure, various ways are described to select a subset of the existing audio streams 11 and thereby allow for 6DOF immersion. As described below, the techniques may improve the listener experience, while also reducing soundfield reproduction localization errors, as the selected subset of the audio streams 11 may better reflect a location of a listener relative to the existing audio streams, thereby improving the operation of a playback device (that performs the techniques to reproduce the soundfield) itself. Moreover, by only selecting a subset of the available audio streams 11, the techniques may reduce resource utilization (in terms of processor cycles, memory, and bus bandwidth consumption) as not all of the audio streams 11 need to be rendered in order to reproduce the soundfield with sufficient resolution.

As shown in the example of FIG. 1A, the audio playback system 16A may include an interpolation device 30 ("INT DEVICE 30"), which may be configured to process one or more of the audio streams 11' to obtain an interpolated audio stream 15 (which is another way to refer to the ambisonic audio data 15). Although shown as being a separate device, the interpolation device 30 may be integrated or otherwise incorporated within one of the audio decoding devices 24.

The interpolation device 30 may be implemented by one or more processors, including fixed function processing circuitry and/or programmable processing circuitry, such as one or more digital signal processors (DSPs), general purpose microprocessors, application specific integrated circuits (ASICs), field programmable gate arrays (FPGAs), or other equivalent integrated or discrete logic circuitry.

The interpolation device 30 may first obtain one or more microphone locations, each of the one or more microphone locations identifying a location of a respective one or more microphones that captured the one or more audio streams 11'. More information regarding operation of the interpolation device 30 is described with respect to the examples of FIGS. 3A-3C.

However, rather than process each and every one of the audio streams 11', the interpolation device 30 may invoke stream selection unit 32 ("SSU 32"), which may select a non-zero subset of the audio streams 11', where the non-zero subset of the audio streams 11' may include less audio streams in number than the total number of the audio streams provided as the audio streams 11'. By reducing the number of the audio streams 11' interpolated by the interpolation device 30, the SSU 32 may reduce resource utilization (in terms of processing cycles, memory, and bus bandwidth) while also potentially retaining accurate reproduction of the soundfield.

In operation, the SSU 32 may obtain a current location 17 (which may also be referred to as a listener location 17) of the content consumer device 14 (e.g., via the tracking device 306). In some examples, the SSU 32 may translate the current location 17 of the content consumer device 14 into a different coordinate system, such as from a real-world coordinate system to a virtual coordinate system. That is, one or more capture locations of the audio streams 11' may be defined relative to the virtual coordinate system so that the audio streams 11' may be correctly rendered by the audio playback system 16B to reflect the virtual world experienced by the consumer when using the content consumer device 14 (e.g., a VR device 14).

The SSU 32 may also obtain capture locations indicative of a location at which a respective of the audio streams 11' is captured. In some examples, the capture locations are defined in the virtual coordinate system, where the virtual coordinate system may reflect locations in a virtual world as opposed to the physical world in which the content consumer device 14 resides. As such, the audio playback system 16A may, as noted above, convert the current location 17 from the real-world coordinate system into the virtual coordinate system prior to selecting the subset of the audio streams 11'.

In any event, the SSU 32 may select, based on the current location 17 and the capture locations of the audio streams 11', a subset of the audio streams 11', where again the subset of the audio streams 11' may have less audio streams than the audio streams 11'. In some instances, the SSU 32 may determine a distance between the current location 17 and the capture locations of the audio streams 11' to obtain a number (or a plurality) of distances. The SSU 32 may select, based on the distances, the subset of the audio streams 11', such as those of the audio streams 11' having a corresponding distance less than a threshold distance.

In conjunction with or as an alternative to the foregoing distance-based selection, the SSU 32 may determine an angular position for each of the capture locations relative to the current location (which may include a viewing angle that defines a zero degree or forward facing angle). The SSU 32 may, when performing distance-based selection and based on the angular positions, select from the nearest number (which may be user, application, or operating system defined, as a couple of examples) of audio streams 11' that provide a sufficient distribution of the audio streams 11' around the listener operating the content consumer device 14 (as described in more detail with respect to the examples shown in FIGS. 2A-2G). The SSU 32 may, when none of the audio streams 11' are within the threshold distance and based on the angular positions, select the subset of the audio streams 11' that provide a sufficient distribution of the audio streams 11' around the listener operating the content consumer device 14.

In some examples, the SSU 32 may perform some analysis on the angular position for each of the capture locations relative to the current location. For example, the SSU 32 may determine an entropy of the angular locations of each of the capture location relative to the current location. The SSU 32 may select the subset of the audio streams 11' so as to maximize the entropy of the angular locations, where a relatively high entropy indicates that the capture locations are spread out uniformly in a sphere and a relatively low entropy indicates that the capture locations are not spread out uniformly in the sphere.

The SSU 32 may output the selected subset of the audio streams 11' to the interpolation device 30, which may perform the above described interpolation with respect to the subset of the audio streams 11'. Considering that the subset of the audio streams 11' does not include all of the audio streams 11', the interpolation device 30 may consume less resources (such as processing cycles, memory, and bus bandwidth) in order to perform the interpolation, thereby potentially improving the operation of the interpolation device itself.

The interpolation device 30 may output the interpolated subset of audio streams 11' as the ambisonic audio data 15. The audio playback system 16A may invoke the renderers 22 to reproduce, based on the ambisonic audio data 15, a soundfield represented by the ambisonic audio data 15. That is, the renderers 22 may apply one or more rendering algorithms to transform the ambisonic audio data 15 from the ambisonic (or, in other words, the spherical harmonic) domain to the spatial domain, generating one or more speaker feeds 25 configured to drive one or more speakers (which are not shown in the example of FIG. 1A) or other types of transducers (including bone-conducting transducers). More information regarding selection of the subset of the audio streams 11' is described with respect to the examples of FIGS. 2A-2G.

Figure 2A:
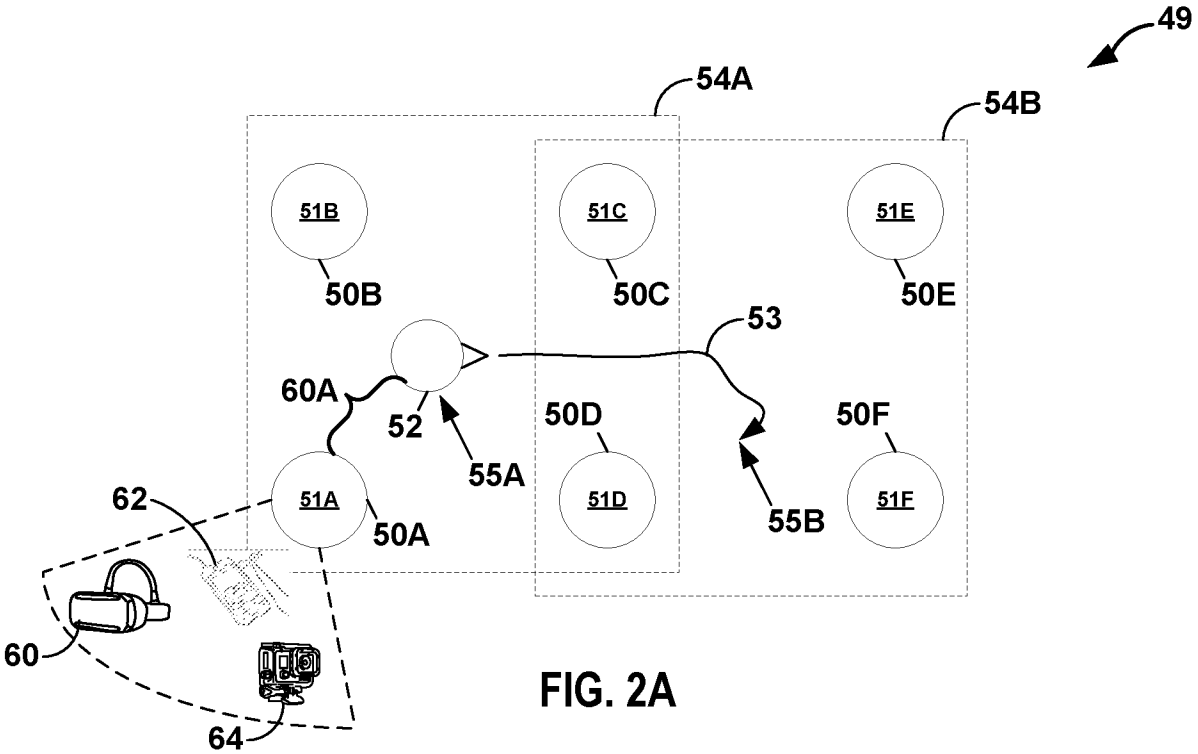
FIGS. 2A-2G are diagrams illustrating, in more detail, example operation of the stream selection unit shown in the example of FIG. 1A in performing various aspects of the stream selection techniques described in this disclosure.

FIGS. 2A-2G are diagrams illustrating, in more detail, example operation of the stream selection unit shown in the example of FIG. 1A in performing various aspects of the stream selection techniques described in this disclosure. In the example of FIG. 2A, a user 52 may wear a VR device, such as the content consumer device 14, to navigate a virtual world 49 in which audio streams 11 are captured via microphones 50A-50F ("microphones 50") at capture locations 51A-51F ("capture locations 51").

As shown with respect to the example microphone 50A, the microphone 50A may be incorporated or otherwise included in one or more devices, such as a VR headset 60, a cellular phone (including a so-called smartphone) 62, a camera 64, etc. Although only shown with respect to the microphone 50A, each of the microphones 50 may be included within a VR device 60, a smartphone 62, a camera 64 or any other type of device capable of including a microphone by which to capture the audio streams 11. The microphones 50 may represent an example of the microphones 5 discussed above with respect to the example of FIG. 1A. Although three example devices 60-64 are shown, the microphones 50 may be included within only a single one of the devices 60-64 or within multiple ones of devices 60-64.

In any event, the SSU 32 may select a first subset 54A of the microphones 50 (which includes microphones 50A-50D having less than all of the microphones 50) when the user 52 operates the content consumer device 14 at the starting location 55A. The SSU 32 may select the first subset 54A of the microphones 50 by determining a distance 60A-60F from a current location 55A of the content consumer device 14 and each of the plurality of capture locations 51 (where only the distance 60A is shown in the example of FIG. 2A for ease of illustration purposes, although a separate distance 60B may be determined from the current location 55A to the capture location 51B, a distance 60C may be determined from the current location 55A to the capture location 51C, etc.).

The SSU 32 may next select, based on the distances 60A-60F ("distances 60"), the subset 54A of the audio streams 11'. As one example, the SSU 32 may compute a total distance as a sum of the distances 60, and then compute an inverse distance for each of the distances 60 to obtain inverse distances. The SSU 32 may next determine a ratio for each of the distances 60 as a corresponding one of the inverse distances divided by the total distance to obtain a number of corresponding ratios. This ratio may also be referred to as a weight throughout this disclosure. Moreover, further discussion of how the weights are computed is provided with respect to FIGS. 3A-6B.

The SSU 32 may select, based on the ratios, the subset 54A of the audio streams 11'. In this example, the SSU 32 may assign, when one of the ratios exceeds a threshold, a corresponding one of the audio streams 11' to the subset 54A of the audio streams 11'. In other words, when the distance between the content consumer device 14 and the capture locations 51 is a smaller distance (as an inverse distance results in a larger number for smaller distances), the SSU 32 may choose those of the audio streams 11' that are closer to the user 52/content consumer device 14. As such, for the starting location 55A, the SSU 32 may select the microphones 50A-50D, assigning the microphones 50A-50D to the subset 54A.

The user 52 may move (where the notch indicates the direction the user 52 is facing) from the left to the right along movement path 53. As the user 52 moves along the movement path 53, the SSU 32 may update the subset of microphones to transition from the subset 54A to the subset 54B of the microphones 50. That is, the SSU 32 may recompute the foregoing ratios (or, in other words, the weights) for each of the microphones 50, selecting a subset 54B of the microphones 50 (i.e., microphones 50C-50F in the example of FIG. 2A) and the corresponding audio streams 11' upon the user 52 reaching an end location 55B at the end of the movement path 53.

Figure 2B:
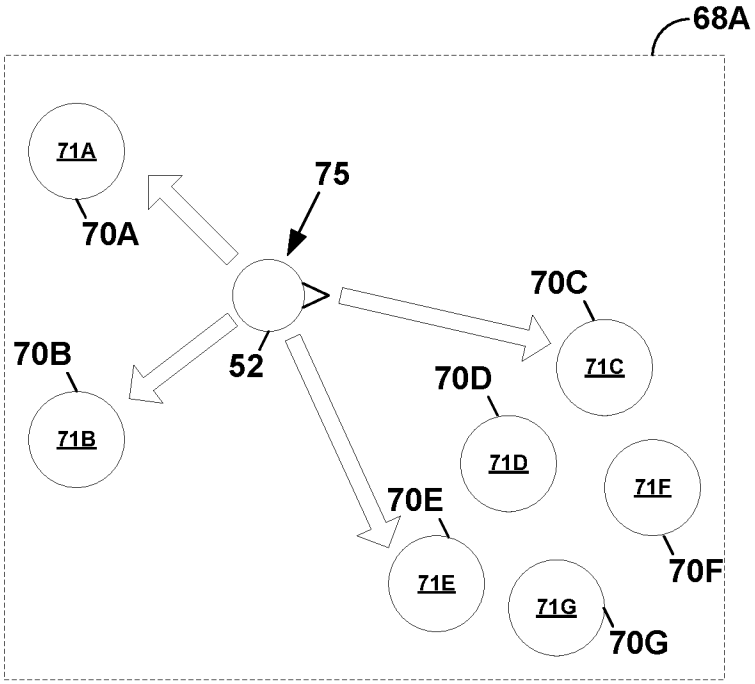

Referring next to the example of FIG. 2B, the user 52 is operating the content consumer device 14 in virtual world 68A in which microphones 70A-70G ("microphones 70") are located at capture locations 71A-71G ("capture locations 71"). The microphones 70 may once again be representative of the microphones 5 shown in the example of FIG. 1A.

In this example, the SSU 32 may select a subset of the microphones 70 to include microphones 70A, 70B, 70C, and 70E, where the selection occurs based both on distance and angular position of the microphones 70 relative to a current location 75 of the user 52. Although described as being both distance and angular position, the SSU 32 may perform the selection based on distance, angular position or a combination of distance and angular position. When both distance and angular position are used to perform the selection, the SSU 32 may, in some example, first select a subset of the microphones 70 based on the distance, and then refine the subset of the microphones 70 to obtain the greatest (or at least threshold) angular diversity (or, in some examples described in more detail below, variance and/or entropy).

To illustrate, the SSU 32 may first form a subset of the audio streams 11' that contribute (or, in other words, have computed weights) above a threshold, e.g., select only streams that contribute above 10% of the aggregate values. The SSU 32 may then perform the selection of the end subset of the audio streams 11' such that the end subset provides a defined or threshold angular spread.

As such, the SSU 32 may determine the angular position for each of the capture locations 71 relative to the current location 71 to obtain the angular positions. In the example of FIG. 2B, it is assumed that the notch of the user 52 defines the zero degree angle, and the SSU 32 determines the angular position relative to the zero degree angle defined by the direction at which the user 52 is looking or, in other words, facing. The angular position may also be referred to as the azimuth. In any event, the SSU 32 may next select, based on the angular positions, the subset of microphones 70 (which again includes microphones 70A, 70B, 70C, and 70E to obtain a corresponding subset of audio streams 11'.

In one example, the SSU 32 may determine a variance of different subsets of the angular position to obtain variances. The SSU 32 may assign, based on the variances, the audio streams 11' to the subset of the audio streams 11'. The SSU 32 may select the subset of the audio streams 11' that provide a highest angular (or, in other words, azimuthal) variance (or at least a variance that exceeds some variance threshold) so as to provide for a full (in terms of angular variance) reproduction of the 360 degree soundfield.

The SSU 32 may, as an alternative to or in conjunction with the above noted variance based selection, determine an entropy of different subsets of the angular positions to obtain entropies. The SSU 32 may assign, based on the entropies, corresponding audio streams 11' from the audio streams 11' to the subset of the audio streams 11'. Again, the SSU 32 may select the subset of the audio streams 11' that provide a highest angular (or, in other words, azimuthal) entropy (or at least an entropy that exceeds some entropy threshold) so as to provide for a full (in terms of angular variance) reproduction of the 360 degree soundfield.

Figure 2C:
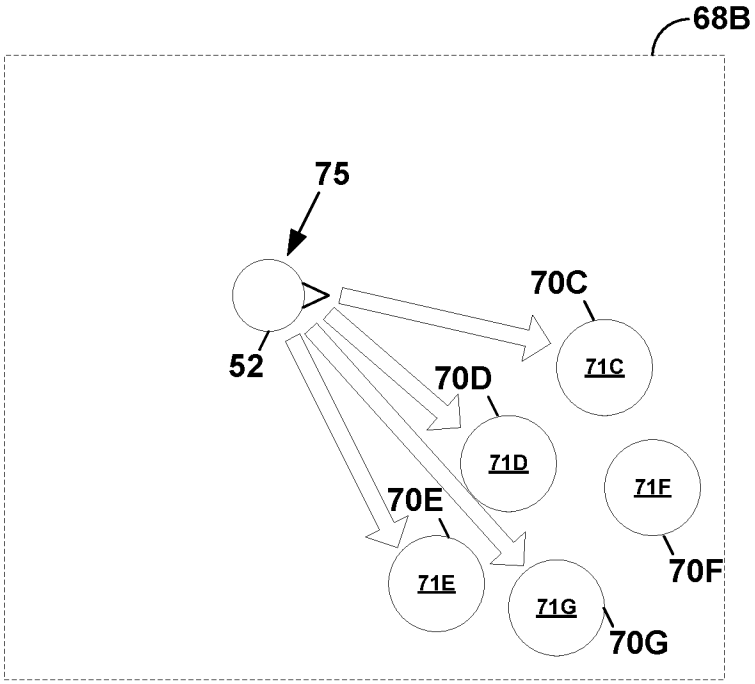

As shown in the example of FIG. 2C, the user 52 is operating the content consumer device 14 in virtual world 68B, which is similar to the virtual world 68B, except that the microphones 70A-70C have been removed. The microphones 70 may once again be representative of the microphones 5 shown in the example of FIG. 1A.

In this example, the SSU 32 may select a subset of the microphones 70 to include microphones 70C, 70D, 70E, and 70G, where the selection occurs based both on distance and angular position of the microphones 70 relative to a current location 75 of the user 52. Although described as being both distance and angular position, the SSU 32 may, as previously noted, perform the selection based on distance, angular position or a combination of distance and angular position.

As such, the SSU 32 may determine the angular position for each of the capture locations 71 relative to the current location 71 to obtain the angular positions. In the example of FIG. 2B, it is assumed that the notch of the user 52 defines the zero degree angle, and the SSU 32 determines the angular position relative to the zero degree angle defined by the direction at which the user 52 is looking or, in other words, facing. The angular position may also be referred to as the azimuth. In any event, the SSU 32 may next select, based on the angular positions, the subset of microphones 70 (which again includes microphones 70A, 70B, 70C, and 70E to obtain a corresponding subset of audio streams 11' in a manner similar to that discussed above.

Although described with respect to selecting a subset of the audio streams 11' that includes four audio streams 11', the techniques may be applied with respect to subsets of the audio streams 11' having any number of audio streams less than the total number of the audio streams 11', where this number may be defined by the user 52, a content creator, dynamically defined according to processor, memory, or other resource utilization, generally dynamically defined as a function of some other criteria, etc. Accordingly, the techniques should not be limited to a statically defined subset of the audio streams 11' that includes only four of the audio streams 11'.

In addition, the user 52 may select or otherwise input various biases to favor the audio streams 11' captured by different ones of the microphones 70. The user 52 may then pre tune for different ones of the microphones 70 based on a perceived importance of the ones of the microphones 70. For example, one of the microphones 70 may be in the vicinity of more audio sources, and the user 52 may bias audio stream selection such that microphones 70 associated with more audio sources are selected. In this respect, the user 52 may override the distance and/or angular position selection process to various degrees using the biases to insert some user preference into the audio stream selection process.

Figure 2E:
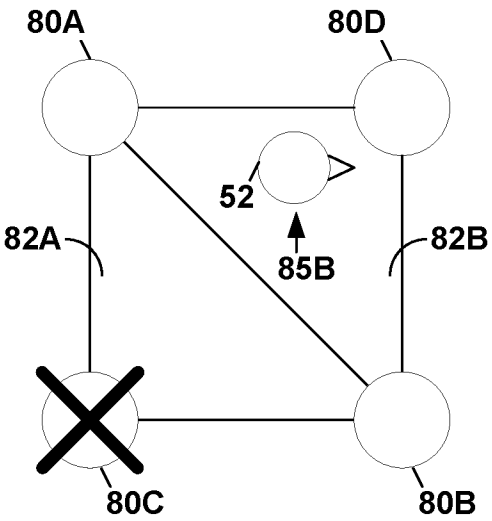
Figure 2D:
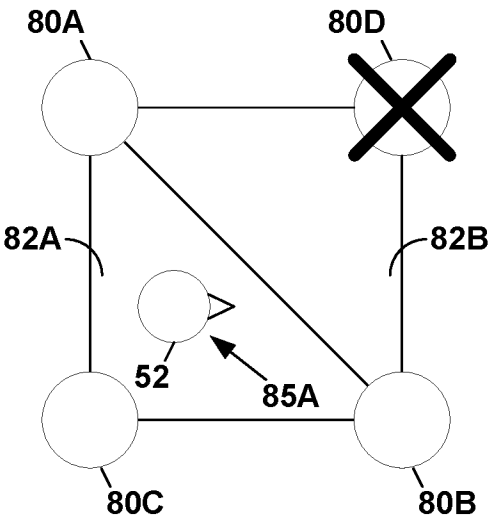

Referring next to the examples shown in FIGS. 2D-2E, the user 52 may, as shown in FIG. 2D, reside in a first audio partition 80A identified by microphones 80A, 80B, and 80C (where the microphones 80A-80D are representative of the microphones 5 shown in the example of FIG. 1). The SSU 32 may, in this example (i.e., when the user 52 resides in the first audio partition 82A), select the audio streams 11' captured by microphones 80A, 80B, and 80C as the subset of the audio streams 11'. As such, the SSU 32 may select, based on the user location 85A and the capture locations of the microphones 80, a region (or, in other words, partition) of validity (ROV), removing the microphone 80D (in this example) based on the ROV.

In the example of FIG. 2E, the user 52 has moved from the first audio partition 82A to the current location 85B. The interpolation unit 30 may invoke the SSU 32 to determine, based on the current location 85B and the capture locations of the microphones 80, the new ROV (i.e., the second audio partition 82B in the example of FIG. 2E). The SSU 32 may then determine, based on the identification of the second audio partition 82B, the subset of the audio streams 11' captured by the microphones 80A, 80B, and 80D, removing the audio stream 11' captured by the microphone 80C.

Figure 2G:
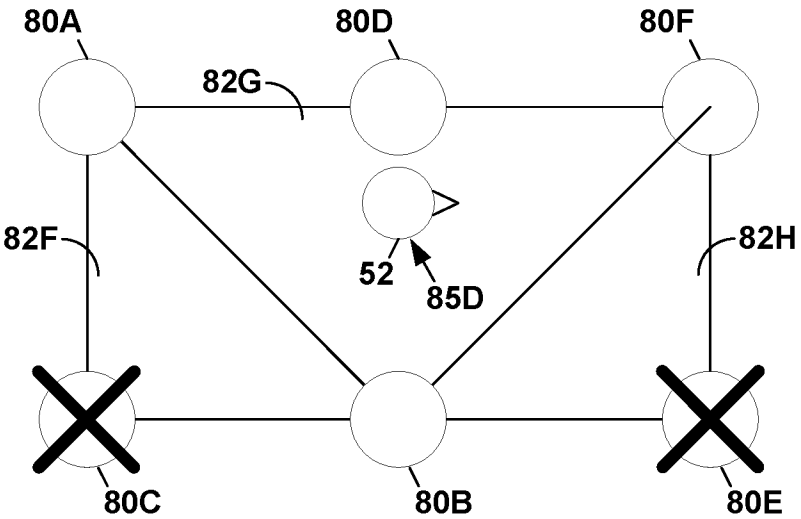
Figure 2F:
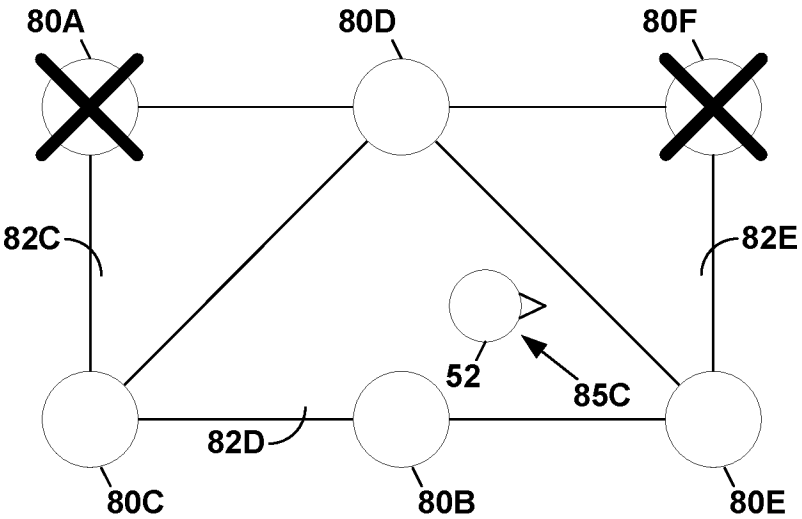

Referring next to the examples of FIGS. 2F and 2G, additional microphones 80E and 80F are added to the virtual world, creating three audio partitions 82C, 82D and 82E. The user 52 is operating the content consumer device 14 at current location 85C. The interpolation unit 30 may invoke the SSU 32 to select, based on the current location 85C and the capture locations of the microphones 80, the audio partition 82D. Based on the audio partition 82D, the SSU 32 may select the subset of the audio streams 11' to include the audio streams 11' captured by the microphones 80B-80E, removing any audio streams 11' captured by the microphones 80A and 80F.

In the example of FIG. 2G, the user 52 is operating the content consumer device 14 at current location 85D. The interpolation unit 30 may invoke the SSU 32 to select, based on the current location 85D and the capture locations of the microphones 80, the audio partition 82G. Based on the audio partition 82G, the SSU 32 may select the subset of the audio streams 11' to include the audio streams 11' captured by the microphones 80A, 80B, 80D, and 80F, removing any audio streams 11' captured by the microphones 80C and 80E.

The foregoing audio stream selection techniques may have a number of different uses in a wide variety of instances. For example, the techniques may apply to recording of live events, e.g., a concert where a listener (e.g., the user 52) may move close to different instruction and around in the scene. As another example, the techniques may apply to AR, where there is a mixture of live and synthetic (or, generated) contents.

In addition, the techniques may promote low cost devices, as the audio stream selection techniques may reduce lag and complexity (as less of the available audio streams 11' are selected). Moreover, the user 52 may use the video stream in accordance with various aspects of the techniques to bias the weights or adapt to user preferences to create spatial effects, while the techniques may also enable the user 52 to preset biases to weights for artistic effect based on a position of the user 52 and potentially time.

Figure 3A:
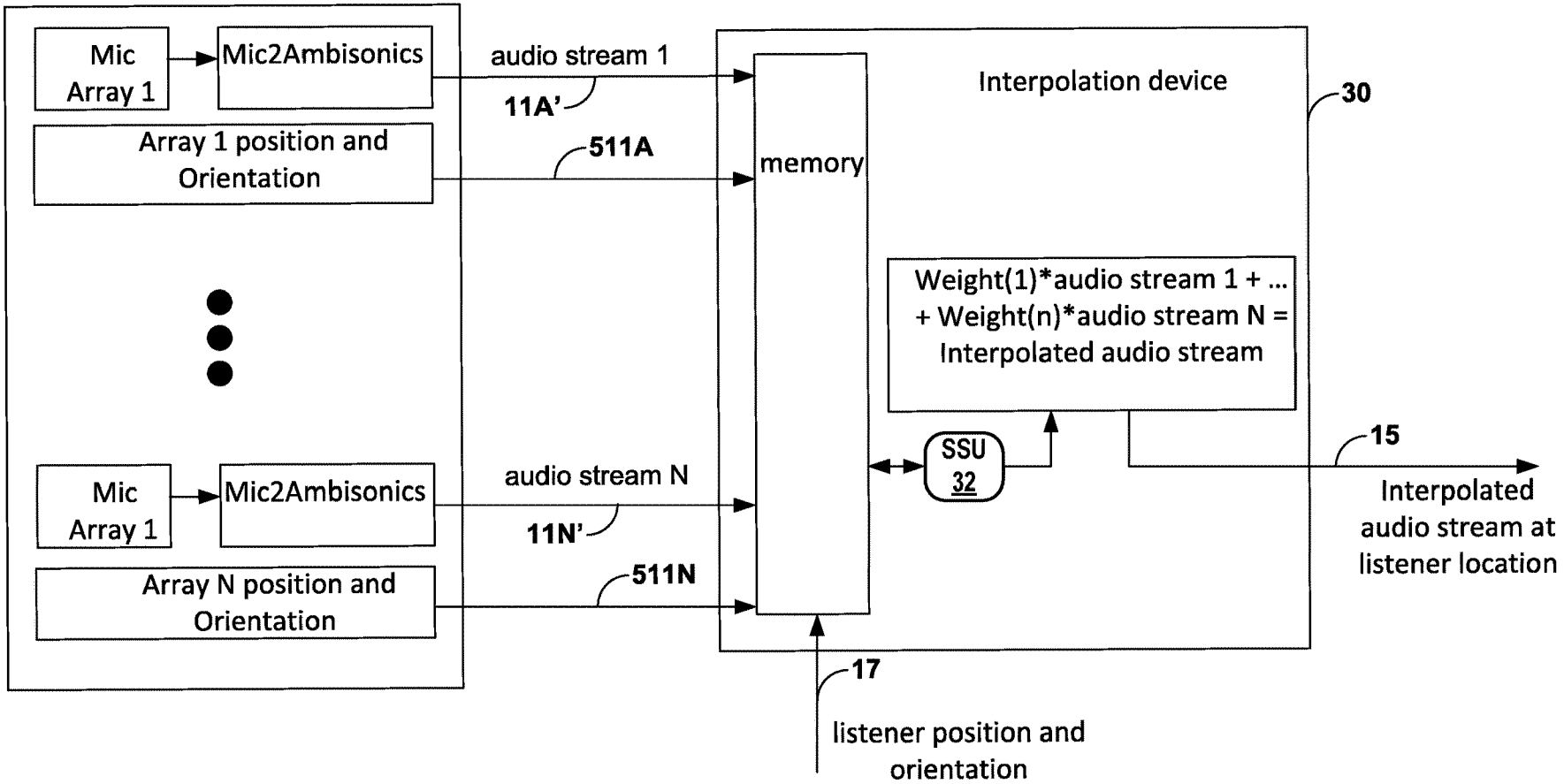
FIG. 3A is a block diagram illustrating further example operation of the interpolation device of FIGS. 1A and 1B in performing various aspects of the audio stream interpolation techniques described in this disclosure.
Figure 3B:
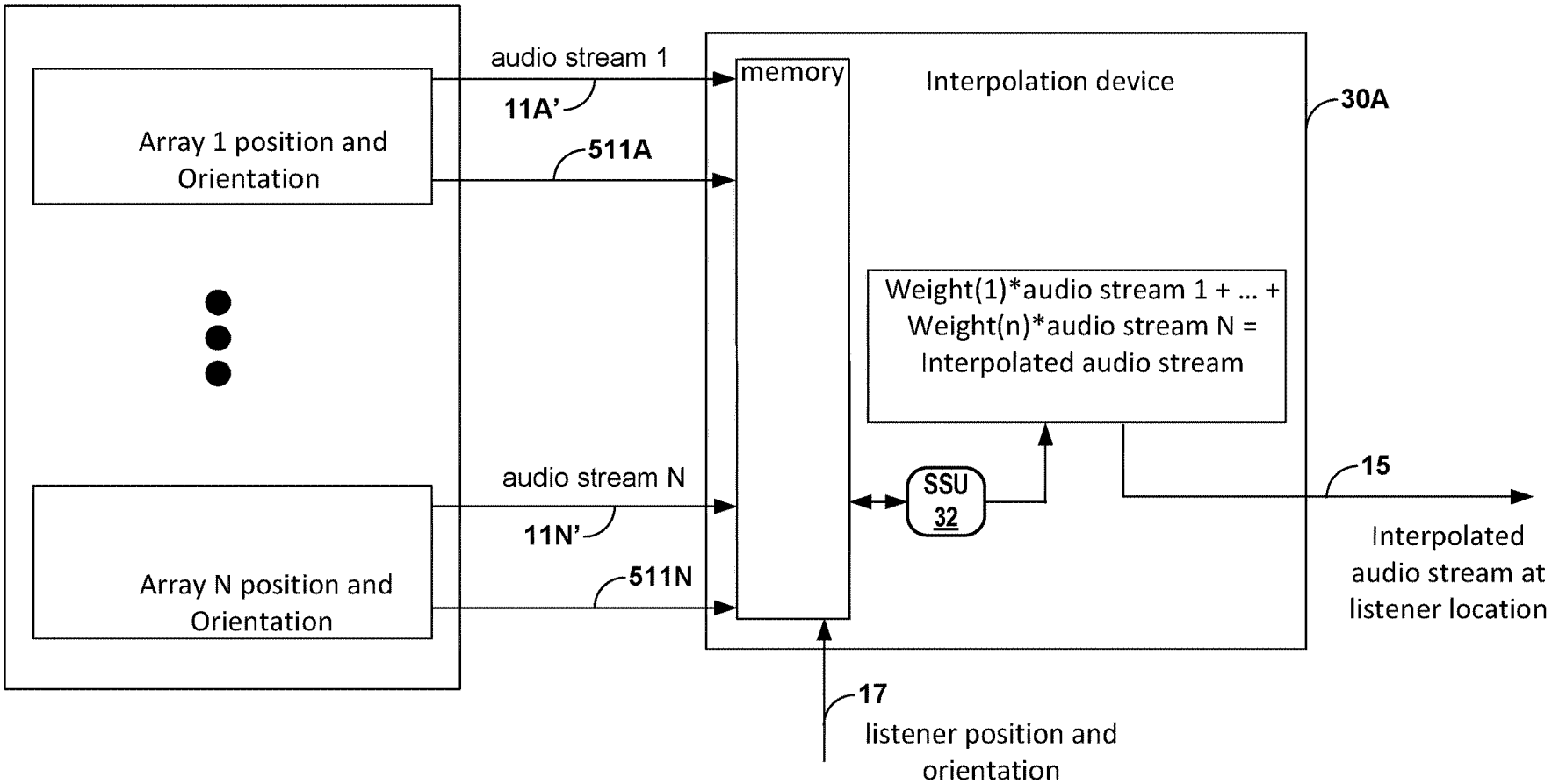
FIG. 3B is a block diagram illustrating yet further example operation of the interpolation device of FIGS. 1A and 1B in performing various aspects of the audio stream interpolation techniques described in this disclosure.
Figure 3C:
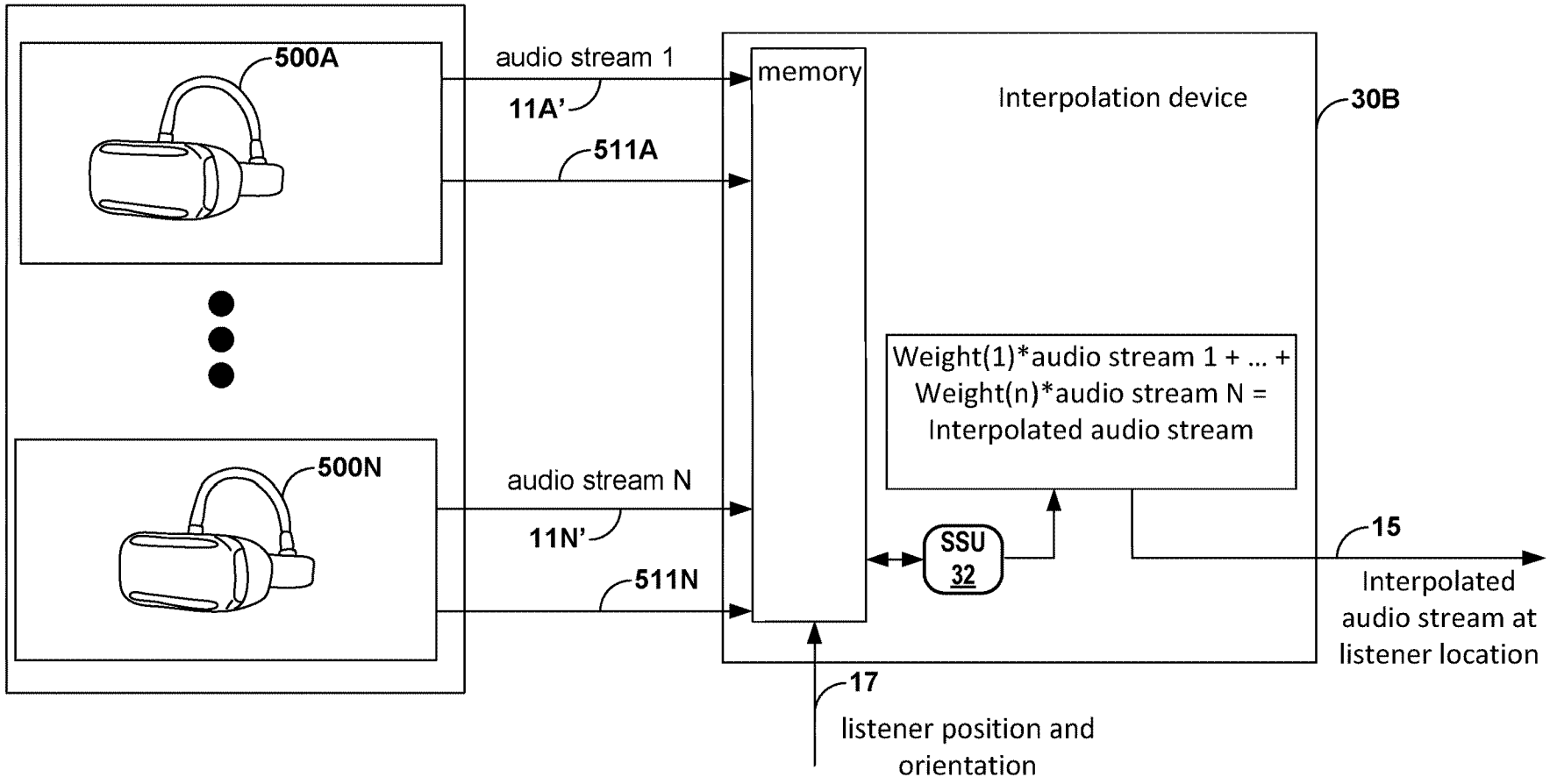
FIG. 3C is a block diagram illustrating yet further example operation of the interpolation device of FIGS. 1A and 1B in performing various aspects of the audio stream interpolation techniques described in this disclosure.

FIG. 3A-3C are block diagrams illustrating example operation of the interpolation device 30 of FIGS. 1A and 1B in performing various aspects of the audio stream interpolation techniques described in this disclosure. In the example of FIG. 3A, the interpolation device 30 receives the subset of the ambisonic audio streams 11' (shown as "ambisonic streams 11'") from the SSU 32, which were captured by microphones 5 (which may, as noted above, represent clusters or arrays of microphones). As noted above, the signals output by the microphones 5 may undergo a conversion from the microphone format to the HOA format, which is shown by the box labeled "MicAmbisonics," resulting in the ambisonic audio streams 11'.

The interpolation device 30 may also receive audio metadata 511A-511N ("audio metadata 511"), which may include a microphone location identifying a location of a corresponding microphone 5A-5N that captured the corresponding one of the audio streams 11'. The microphones 5 may provide the microphone location, an operator of the microphones 5 may enter the microphone locations, a device coupled to the microphone (e.g., the content capture device 300) may specify the microphone location, or some combination of the foregoing. The content capture device 300 may specify the audio metadata 511 as part of the content 301. In any event, the SSU 32 may parse the audio metadata 511 from the bitstream 21 representative of the content 301.

The SSU 32 may also obtain a listener location 17 that identifies a location of a listener, such as that shown in the example of FIG. 5A. The audio metadata may specify a location and an orientation of the microphone as shown in the example of FIG. 3A, or only a microphone location. Further, the listener location 17 may include a listener position (or, in other words, location) and an orientation, or only a listener location. Referring briefly back to FIG. 1A, the audio playback system 16A may interface with a tracking device 306 to obtain the listener location 17. The tracking device 306 may represent any device capable of tracking the listener, and may include one or more of a global positioning system (GPS) device, a camera, a sonar device, an ultrasonic device, an infrared emitting and receiving device, or any other type of device capable of obtaining the listener location 17.

The SSU 32 may next perform the foregoing audio stream selection to obtain a subset of the audio streams 11'. The SSU 32 may output the subset of the audio streams 11' to the interpolation device 30.

The interpolation device 30 may next perform interpolation, based on the one or more microphone locations and the listener location 17, with respect to the subset of the audio streams 11' to obtain interpolated audio stream 15. The audio streams 11' may originally be stored in a memory of the interpolation device 30, and the SSU 32 may refer to the subset of the audio streams 11' using pointers or other data constructs, rather than retrieve and send the subset of the audio streams 11' to the interpolation device 30. To perform the interpolation, the interpolation device 30 may read the subset of the audio streams 11' form memory and determine, based on the one or more microphones locations and the listener location 17 (which may also be stored in the memory), a weight for each of the audio streams (which are shown as Weight(1) . . . Weight(n)).

This SSU 32 may utilize this weight when identifying the subset of the audio streams 11' as described above. In some examples, the SSU 32 may determine the weights and provide the weights to the interpolation device 30 in order to perform the interpolation.

In any event, to determine the weights, the interpolation device 30 may calculate each weight as a ratio of inverse distance to the listener location 17 for the corresponding one of the audio streams 11' by the total inverse distance from all of the other audio streams 11', except for the edge cases when the listener is at the same location as one of the microphones 5 as represented in the virtual world. That is to say, it may be possible for a listener to navigate a virtual world, or a real world location represented on a display of a device, which has the same location as where one of the microphones 5 captured the audio srtreams 11'. When the listener is at the same location as one of the microphones 5, the interpolation unit 30 may calculate the weight for the one of the audio streams 11' captured by the one of the microphones 5 at which the listener is at the same location as one of the microphones 5, and the weights for the remaining audio streams 11' are set to zero.

Otherwise, the interpolation device 30 may calculate each weight as follows: Weight(n)=(1/(distance of mic n to the listener position))/(1/(distance of mic 1 to the listener position)+ . . . +1/(distance of mic n to the listener position)), In the above, the listener position refers to the listener position 17, Weight(n) refers to the weight for the audio stream 11N', and the distance of mic <number> to the listener position refers to the absolute value of the difference between the corresponding microphone location and the listener position 17.

The interpolation device 30 may next multiply the weight by the corresponding one of the subset of the audio streams 11' to obtain one or more weighted audio streams, which the interpolation device 30 may add together to obtain the interpolated audio stream 15. The foregoing may be denoted mathematically by the following equation: Weight(1)*audio stream 1+ . . . +Weight(n)*audio stream n=Interpolated audio stream, where Weight(<number>) denotes the weight for the corresponding audio stream <number>, and the interpolated ambisonic audio data refers to the interpolated audio stream 15. The interpolated audio stream may be stored in the memory of the interpolation device 30 and may also be available to be played out by loudspeakers (e.g., a VR or AR device or a headset worn by the listener). The interpolation equation represents the weighted average ambisonic audio shown in the example of FIG. 3A. It should be noted that it may be possible in some configuration to interpolate non-ambisonic audio streams; however, there may be a loss of audio quality or resolution if the interpolation is not performed on ambisonic audio data.

In some examples, the interpolation device 30 may determine the foregoing weights on a frame-by-frame basis. In other examples, the interpolation device 30 may determine the foregoing weights on a more frequent basis (e.g., some sub-frame basis) or on a more infrequent basis (e.g., after some set number of frames). In these and other examples, the interpolation device 30 may only calculate the weights responsive to detection of some change in the listener location and/or orientation or responsive to some other characteristics of the underlying ambisonic audio streams (which may enable and disable various aspects of the interpolation techniques described in this disclosure).

In some examples, the above techniques may only be enabled with respect to the audio streams 11' having certain characteristics. For example, the interpolation device 30 may only interpolate the audio streams 11' when audio sources represented by the audio streams 11' are located at locations different than the microphones 5. More information regarding this aspect of the techniques is provided below with respect to FIGS. 4A and 4B.

Figure 4A:
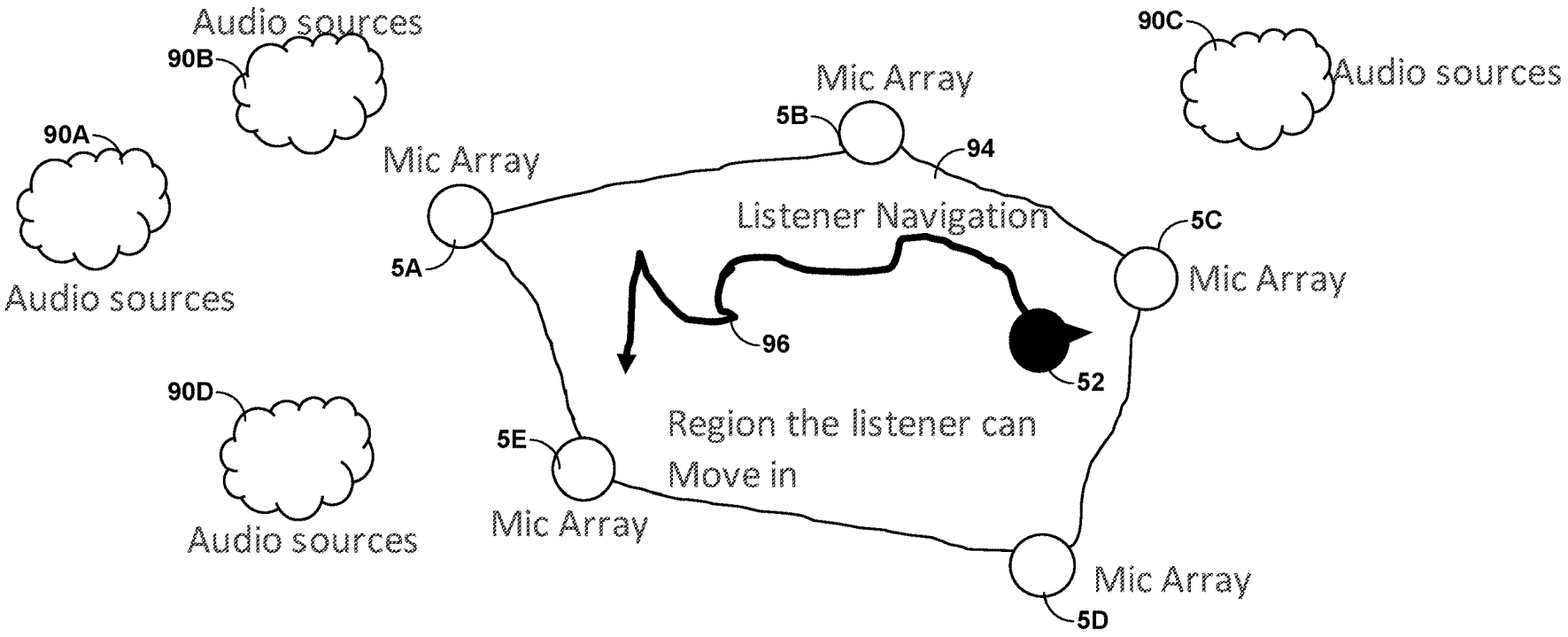
FIG. 4A is a diagram illustrating, in more detail, how the interpolation device of FIGS. 1A-2 may perform various aspects of the techniques described in this disclosure.

FIG. 4A is a diagram illustrating, in more detail, how the interpolation device of FIGS. 1A, 1B, and 3A may perform various aspects of the techniques described in this disclosure. As shown in FIG. 4A, the listener 52 may progress within the area 94 defined by the microphones (shown as "mic arrays") 5A-5E. In some examples, the microphones 5 (including when the microphones 5 represent clusters or, in other words, arrays of microphones) may be positioned at a distance from one another that is greater than five feet. In any event, the interpolation device 30 (referring to FIG. 3A) may perform the interpolation when sound sources 90A-90D ("sound sources 90" or "audio sources 90" as shown in FIG. 4A) are outside of the area 94 defined by the microphones 5A-5E given mathematical constraints imposed by the equations discussed above.

Returning to the example of FIG. 4A, the listener 52 may enter or otherwise issue one or more navigational commands (potentially by walking or through use of a controller or other interface device, including smart phones, etc.) to navigate within the area 94 (along the line 96). A tracking device (such as the tracking device 306 shown in the example FIG. 3A) may receive these navigational commands and generate the listener location 17.

As the listener 52 starts navigating from the starting location, the interpolation device 30 may generate the interpolated audio stream 15 to heavily weight the audio stream 11C' captured by the microphone 5C, and assign relatively less weight to the audio stream 11B' captured by the microphone 5B and the audio stream 11D' captured by the microphone 5D, and still relatively less weight (and possibly no weight) to the audio streams 11A' and 11E' (which the SSU 32 may exclude, per the audio stream selection techniques discussed above, from the subset of the audio streams 11') captured by the respective microphones 5A and 5E.

As the listener 52 navigates along the line 96 next to the location of the microphone 5B, the interpolation device 30 may assign more weight to the audio stream 11B', relatively less weight to the audio stream 11C' and yet less weight (and possibly no weight) to the audio streams 11A', 11D', and 11E'. As the listener 52 navigates (where the notch indicates the direction in which the listener 52 is moving) closer to the location of the microphone 5E toward the end of the line 96, the interpolation device 30 may assign more weight to the audio stream 11E', relatively less weight to the audio stream 11A', and yet relatively less weight (and possibly no weight, as the SSU 32 may exclude the these audio streams) to the audio streams 11B', 11C', and 11D'.

In this respect, the interpolation device 30 may perform interpolation based on changes to the listener location 17 based on navigational commands issued by the listener 32 to assign varying weights over time to the audio streams 11A'-11E'. The changing listener location 17 may result in different emphasis within the interpolated audio stream 15, thereby promoting better auditory localization within the area 94.

Although not described in the examples set forth above, the techniques may also adapt to changes in the location of the microphones. In other words, the microphones may be manipulated during recording, changing locations and orientations. Because the above noted equations are only concerned with differences between the microphone locations and the listener location 17, the interpolation device 30 may continue to perform the interpolation even though the microphones have been manipulated to change location and/or orientation.

Figure 4B:
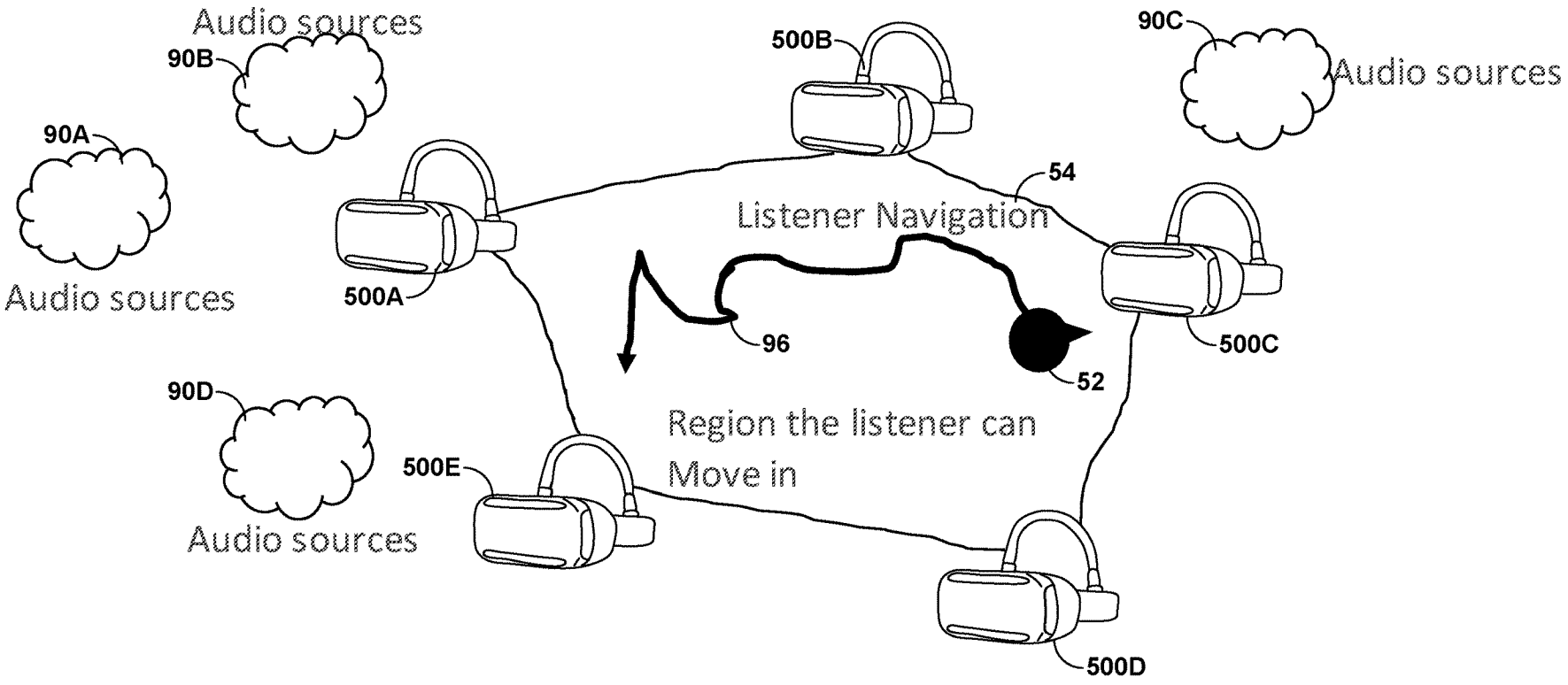
FIG. 4B is a block diagram illustrating, in more detail, how the interpolation device of FIGS. 1A-2 may perform various aspects of the techniques described in this disclosure.

FIG. 4B is a block diagram illustrating, in more detail, how the interpolation device of FIGS. 1A, 1B, and 3A may perform various aspects of the techniques described in this disclosure. The example shown in FIG. 4B is similar to the example shown in FIG. 4A, except that the microphones 5 are replaced with wearable devices 500A-500E (which may represent an example of wearable devices 400A and/or 400B). The wearable devices 500A-500E may each include a microphone that captures the audio streams described in more detail above.

FIG. 3B is a block diagram illustrating further example operation of the interpolation device of FIGS. 1A and 1B in performing various aspects of the audio stream interpolation techniques described in this disclosure. The interpolation device 30A shown in the example of FIG. 3B is similar to that shown in the example of FIG. 3A, except that the interpolation device 30 shown in FIG. 3A receives audio streams 11' that were not captured from a microphone (and that which were pre-captured and/or mixed). The interpolation device 30 shown in the example of FIG. 3A represents an example use during live capture (for live events, like sporting events, concerts, lectures, etc.), while the interpolation device 30A shown in the example of FIG. 3B represents an example use during pre-recorded or generated events (such as video games, movies, etc.). The interpolation device 30A may include a memory for storing the audio streams as shown in FIG. 3B.

FIG. 3C is a block diagram illustrating yet further example operation of the interpolation device of FIGS. 1A and 1B in performing various aspects of the audio stream interpolation techniques described in this disclosure. The example shown in FIG. 3C is similar to the example shown in FIG. 3B except that wearable devices 500A-500N may capture audio streams 11A-11N (which are compressed and decoded as the audio streams 11A'-11N'). The interpolation device 30B may include a memory for storing the audio streams as shown in FIG. 3B.

FIG. 1B is a block diagram illustrating another example system 100 configured to perform various aspects of the techniques described in this disclosure. The system 100 is similar to the system 10 shown in FIG. 1A, except that the audio renderers 22 shown in FIG. 1A are replaced with a binaural renderer 102 capable of performing binaural rendering using one or more HRTFs or the other functions capable of rendering to left and right speaker feeds 103.

The audio playback system 16B may output the left and right speaker feeds 103 to headphones 104, which may represent another example of a wearable device and which may be coupled to additional wearable devices to facilitate reproduction of the soundfield, such as a watch, the VR headset noted above, smart glasses, smart clothing, smart rings, smart bracelets or any other types of smart jewelry (including smart necklaces), and the like. The headphones 104 may couple wirelessly or via wired connection to the additional wearable devices.

Additionally, the headphones 104 may couple to the audio playback system 16 via a wired connection (such as a standard 3.5 mm audio jack, a universal system bus (USB) connection, an optical audio jack, or other forms of wired connection) or wirelessly (such as by way of a Bluetooth™ connection, a wireless network connection, and the like). The headphones 104 may recreate, based on the left and right speaker feeds 103, the soundfield represented by the ambisonic coefficients 11. The headphones 104 may include a left headphone speaker and a right headphone speaker which are powered (or, in other words, driven) by the corresponding left and right speaker feeds 103.

Although described with respect to a VR device as shown in the example of FIGS. 7A and 7B, the techniques may be performed by other types of wearable devices, including watches (such as so-called "smart watches"), glasses (such as so-called "smart glasses"), headphones (including wireless headphones coupled via a wireless connection, or smart headphones coupled via wired or wireless connection), and any other type of wearable device. As such, the techniques may be performed by any type of wearable device by which a user may interact with the wearable device while worn by the user.

Figure 6A:
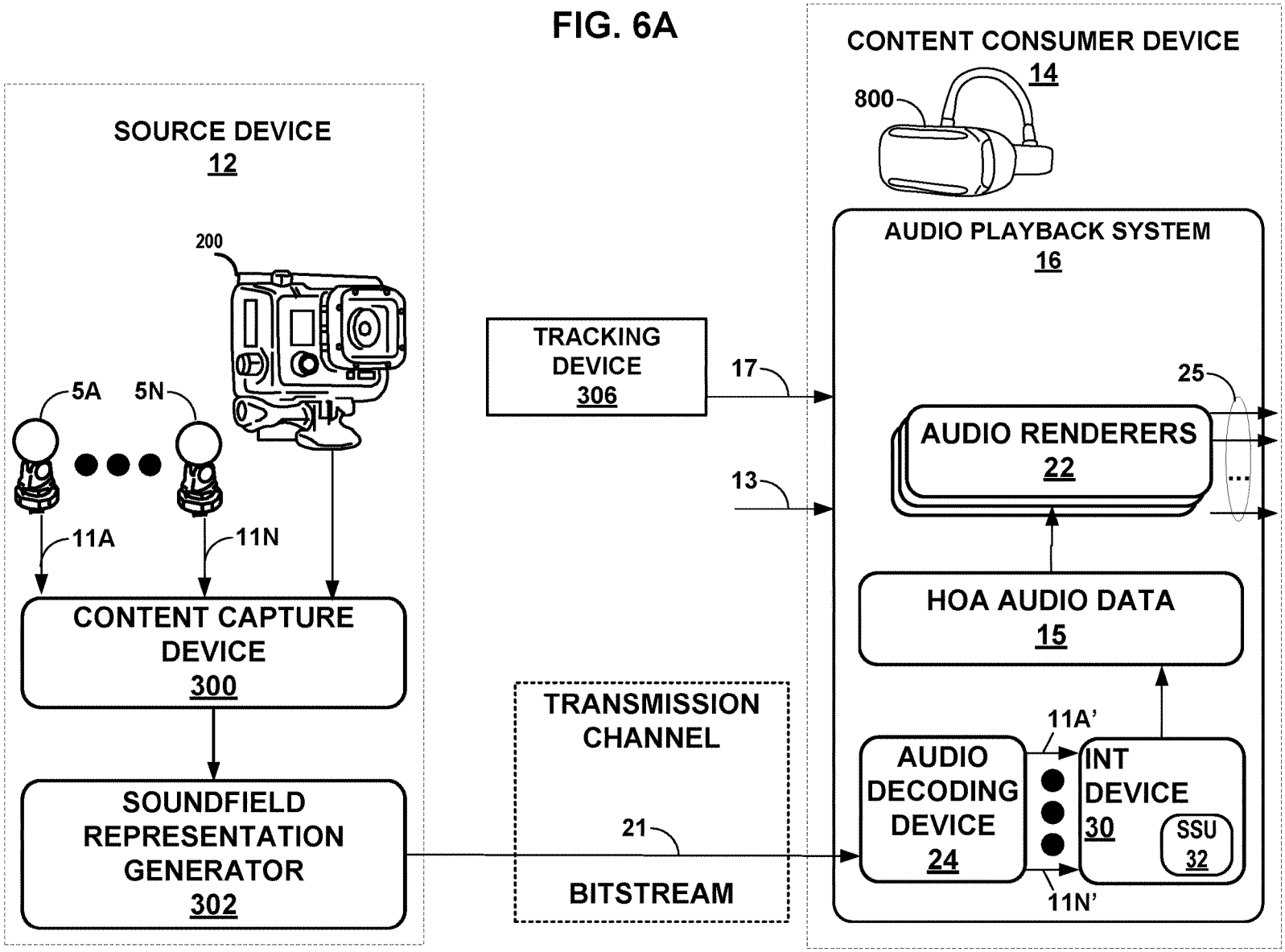
FIGS. 6A and 6B are diagrams illustrating example systems that may perform various aspects of the techniques described in this disclosure.
Figure 6B:
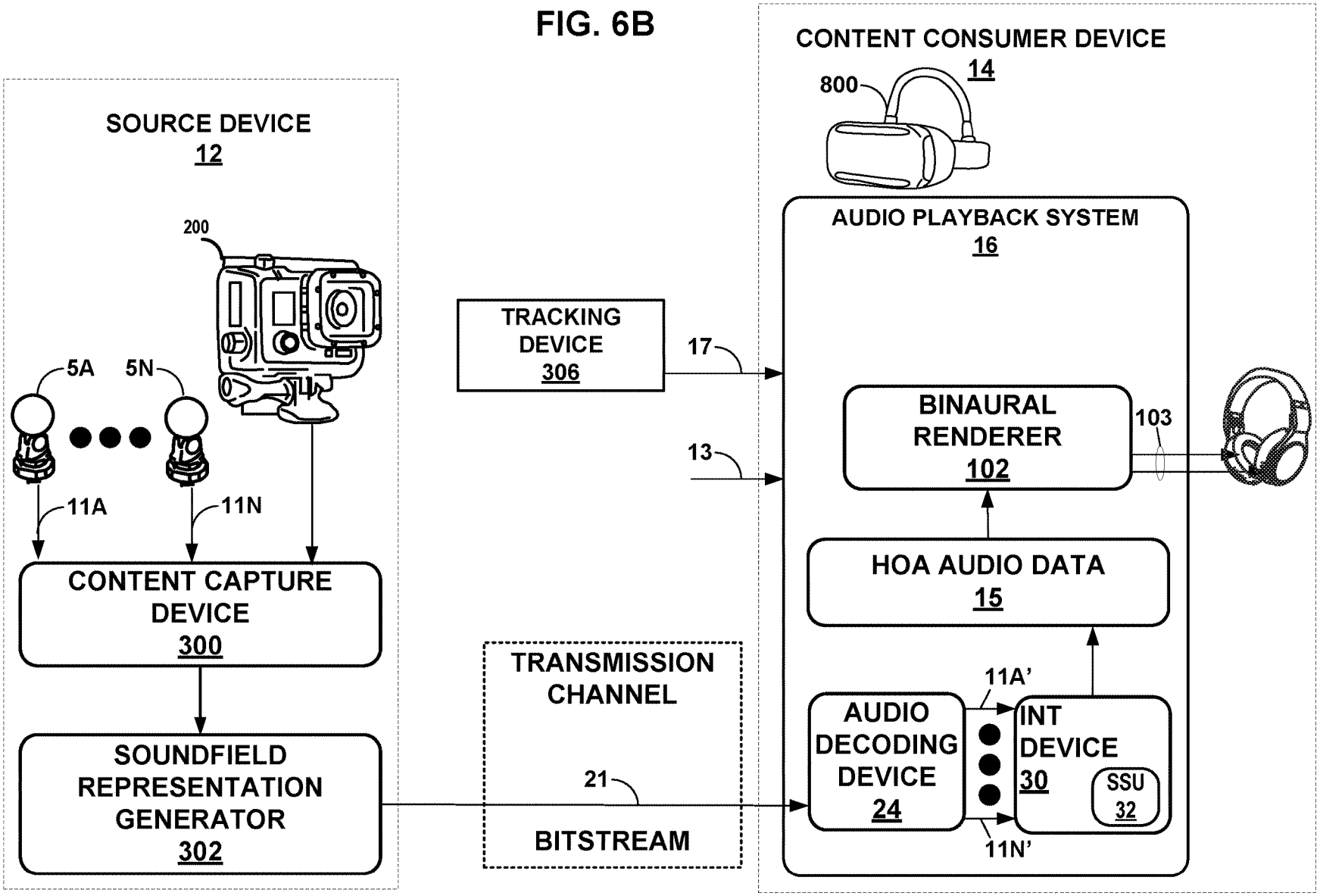

FIGS. 6A and 6B are diagrams illustrating example systems that may perform various aspects of the techniques described in this disclosure. FIG. 6A illustrates an example in which the source device 12 further includes a camera 200. The camera 200 may be configured to capture video data, and provide the captured raw video data to the content capture device 300. The content capture device 300 may provide the video data to another component of the source device 12, for further processing into viewport-divided portions.

In the example of FIG. 6A, the content consumer device 14 also includes the wearable device 800. It will be understood that, in various implementations, the wearable device 800 may be included in, or externally coupled to, the content consumer device 14. As discussed above with respect to FIGS. 5A and 5B, the wearable device 800 includes display hardware and speaker hardware for outputting video data (e.g., as associated with various viewports) and for rendering audio data.

FIG. 6B illustrates an example similar that illustrated by FIG. 6A, except that the audio renderers 22 shown in FIG. 6A are replaced with a binaural renderer 102 capable of performing binaural rendering using one or more HRTFs or the other functions capable of rendering to left and right speaker feeds 103. The audio playback system 16 may output the left and right speaker feeds 103 to headphones 104.

The headphones 104 may couple to the audio playback system 16 via a wired connection (such as a standard 3.5 mm audio jack, a universal system bus (USB) connection, an optical audio jack, or other forms of wired connection) or wirelessly (such as by way of a Bluetooth™ connection, a wireless network connection, and the like). The headphones 104 may recreate, based on the left and right speaker feeds 103, the soundfield represented by the ambisonic coefficients 11. The headphones 104 may include a left headphone speaker and a right headphone speaker which are powered (or, in other words, driven) by the corresponding left and right speaker feeds 103.

Figure 7:
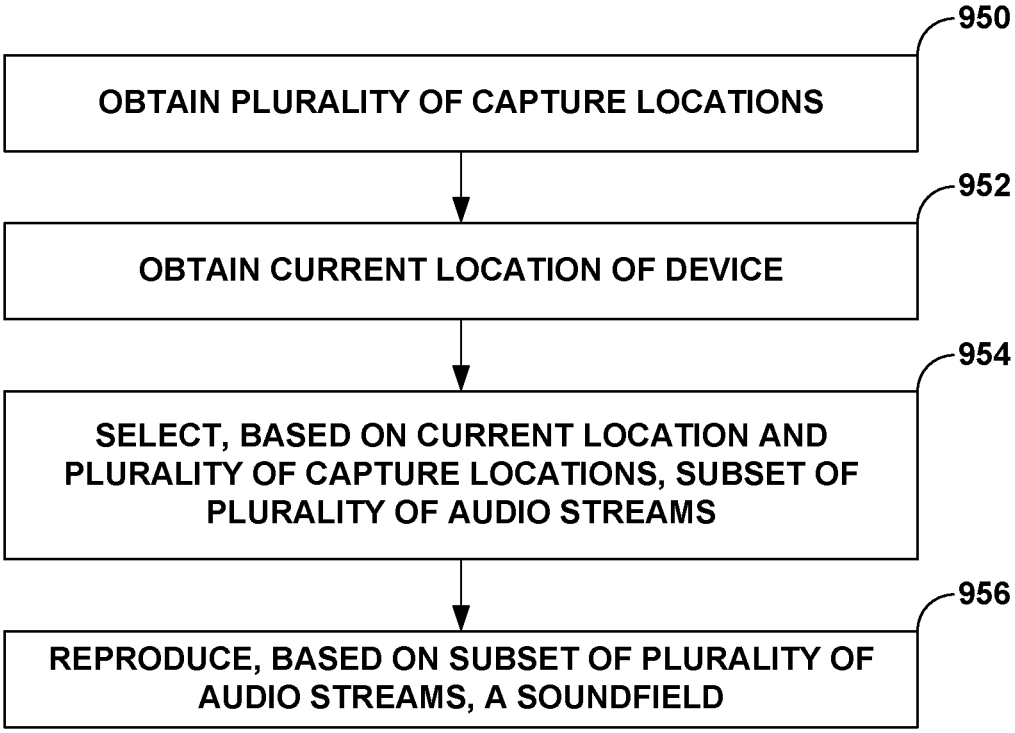
FIG. 7 is a flowchart illustrating example operation of the systems of FIGS. 1A 1B-6B in performing various aspects of the audio interpolation techniques described in this disclosure.

FIG. 7 is a flowchart illustrating example operation of the audio playback system of FIGS. 1A-6B in performing various aspects of the audio interpolation techniques described in this disclosure. The SSU 32 shown in the example of FIG. 1A may first obtain one or more capture locations (950), each of the one or more capture locations identifying a location of a respective one or more microphones that captured each of the corresponding one or more audio streams 11' (in the virtual coordinate system). The SSU 32 may next obtain a current location 17 of the content consumer device 14 (952).

The SSU 32 may, as described above in more detail, select, based on the current location 17 and the plurality of capture locations, a subset of the plurality of audio streams 11' (954). The audio playback system 16 may next invoke the audio renderers 22 to obtain, based on the subset of the plurality of audio streams 11' (e.g., ambisonic audio data 15), one or more speaker feeds 25. The audio playback system 16 may output the one or more speaker feeds 25 to drive or otherwise power transducers (e.g., speakers). In this manner, the audio playback system 16 may reproduce, based on the subset of the plurality of audio streams 11', a soundfield (956).

Figure 8:
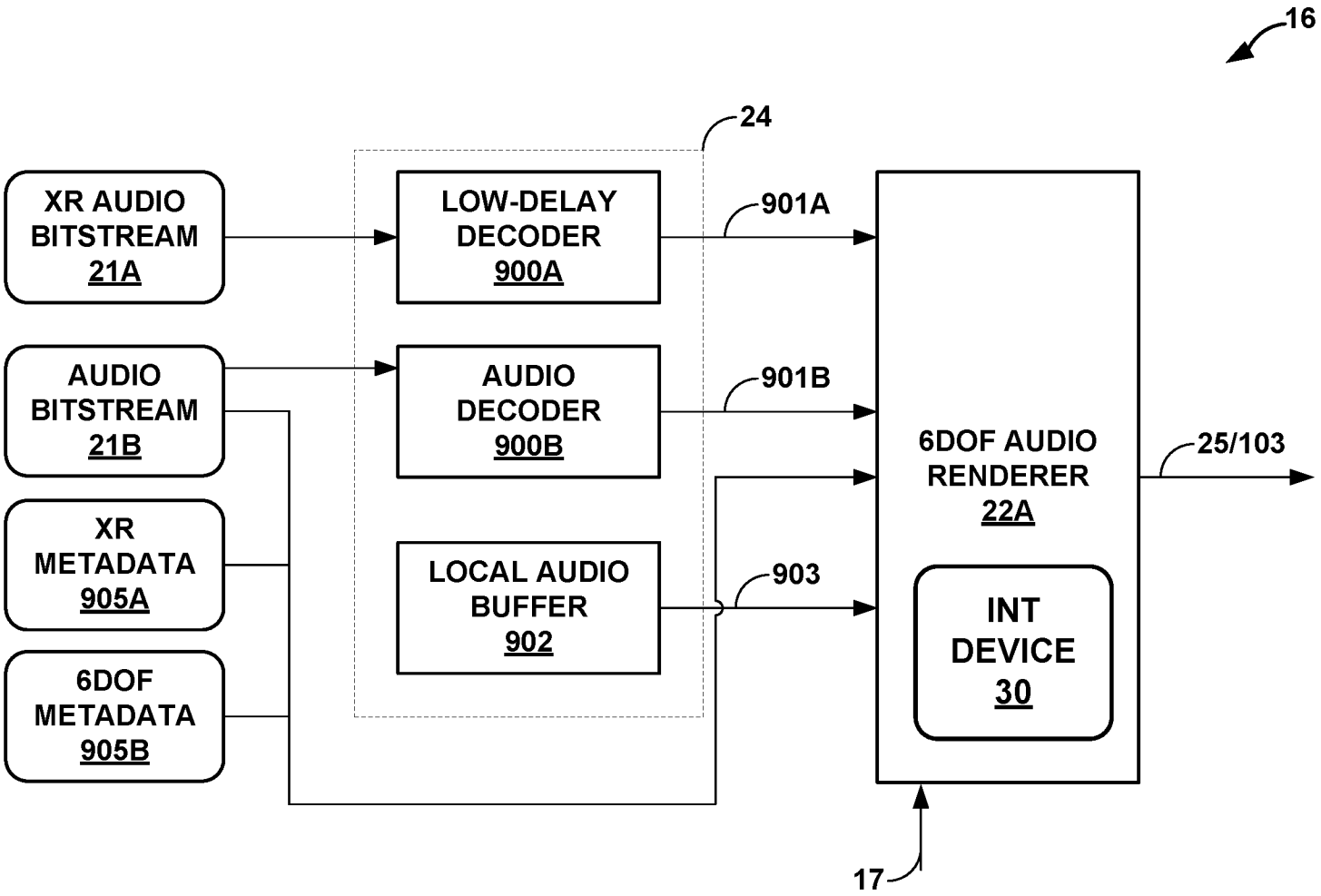
FIG. 8 is a block diagram of the audio playback device shown in the examples of FIGS. 1A and 1B in performing various aspects of the techniques described in this disclosure.

FIG. 8 is a block diagram of the audio playback device shown in the examples of FIGS. 1A and 1B in performing various aspects of the techniques described in this disclosure. The audio playback device 16 may represent an example of the audio playback device 16A and/or the audio playback device 16B. The audio playback system 16 may include the audio decoding device 24 in combination with a 6DOF audio renderer 22A, which may represent one example of the audio renderers 22 shown in the example of FIG. 1A.

The audio decoding device 24 may include a low delay decoder 900A, an audio decoder 900B, and a local audio buffer 902. The low delay decoder 900A may process XR audio bitstream 21A to obtain audio stream 901A, where the low delay decoder 900A may perform relatively low complexity decoding (compared to the audio decoder 900B) to facilitate low delay reconstruction of the audio stream 901A. The audio decoder 900B may perform relatively higher complexity decoding (compared to the audio decoder 900A) with respect to the audio bitstream 21B to obtain audio stream 901B. The audio decoder 900B may perform audio decoding that conforms to the MPEG-H 3D Audio coding standard. The local audio buffer 902 may represent a unit configured to buffer local audio content, which the local audio buffer 902 may output as audio stream 903.

The bitstream 21 (comprised of one or more of the XR audio bitstream 21A and/or the audio bitstream 21B) may also include XR metadata 905A (which may include the microphone location information noted above) and 6DOF metadata 905B (which may specify various parameters related to 6DOF audio rendering). The 6DOF audio renderer 22A may obtain the audio streams 901A, 901B, and/or 903 along with the XR metadata 905A and the 6DOF metadata 905B and render the speaker feeds 25 and/or 103 based on the listener positions and the microphone positions. In the example of FIG. 8, the 6DOF audio renderer 22A includes the interpolation device 30, which may perform various aspects of the audio stream selection and/or interpolation techniques described in more detail above to facilitate 6DOF audio rendering.

Figure 9:
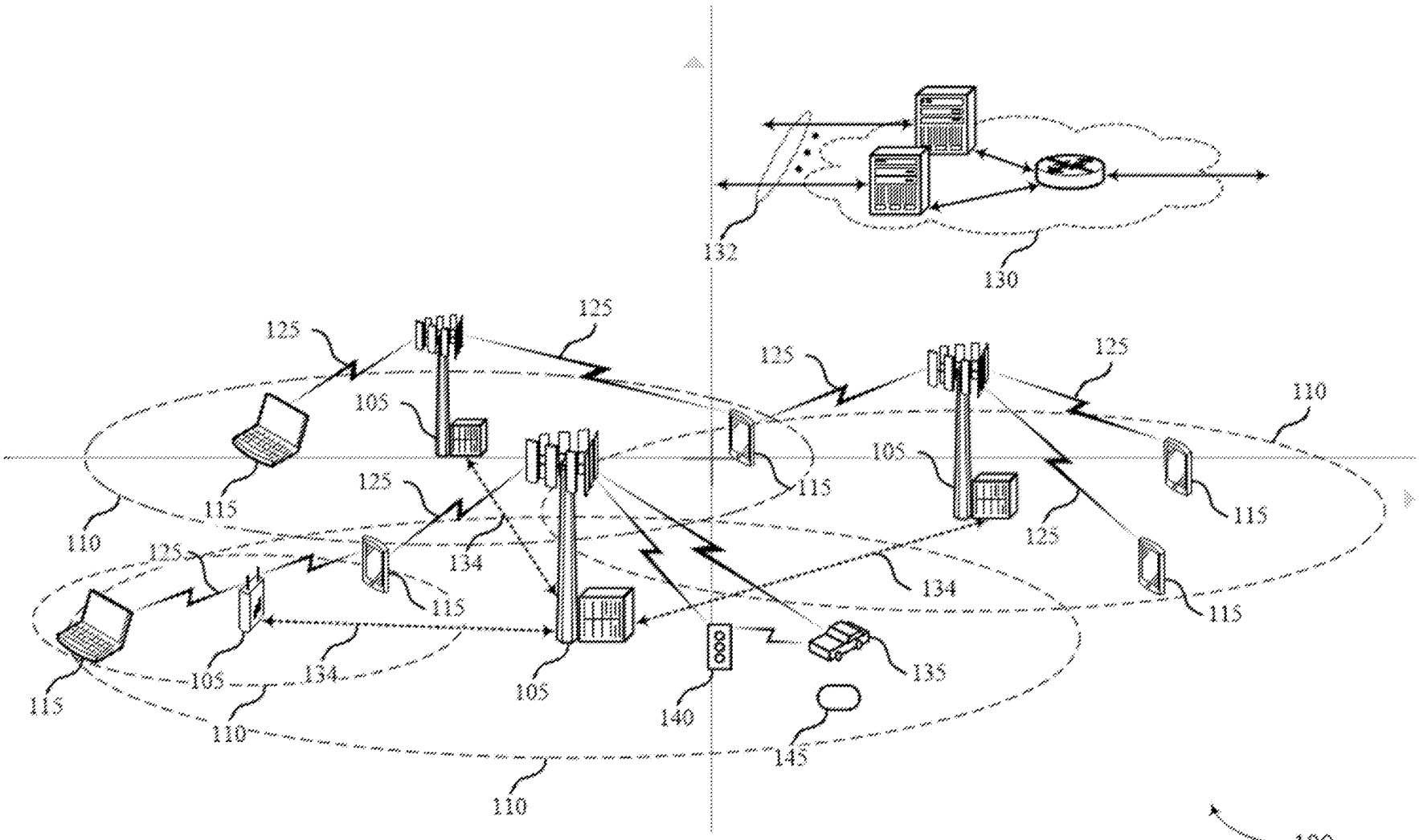
FIG. 9 illustrates an example of a wireless communications system that supports audio streaming in accordance with aspects of the present disclosure.

FIG. 9 illustrates an example of a wireless communications system 100 that supports audio streaming in accordance with aspects of the present disclosure. The wireless communications system 100 includes base stations 105, UEs 115, and a core network 130. In some examples, the wireless communications system 100 may be a Long Term Evolution (LTE) network, an LTE-Advanced (LTE-A) network, an LTE-A Pro network, or a New Radio (NR) network. In some cases, wireless communications system 100 may support enhanced broadband communications, ultra-reliable (e.g., mission critical) communications, low latency communications, or communications with low-cost and low-complexity devices.

Base stations 105 may wirelessly communicate with UEs 115 via one or more base station antennas. Base stations 105 described herein may include or may be referred to by those skilled in the art as a base transceiver station, a radio base station, an access point, a radio transceiver, a NodeB, an eNodeB (eNB), a next-generation NodeB or giga-NodeB (either of which may be referred to as a gNB), a Home NodeB, a Home eNodeB, or some other suitable terminology. Wireless communications system 100 may include base stations 105 of different types (e.g., macro or small cell base stations). The UEs 115 described herein may be able to communicate with various types of base stations 105 and network equipment including macro eNBs, small cell eNBs, gNBs, relay base stations, and the like.

Each base station 105 may be associated with a particular geographic coverage area 110 in which communications with various UEs 115 is supported. Each base station 105 may provide communication coverage for a respective geographic coverage area 110 via communication links 125, and communication links 125 between a base station 105 and a UE 115 may utilize one or more carriers. Communication links 125 shown in wireless communications system 100 may include uplink transmissions from a UE 115 to a base station 105, or downlink transmissions from a base station 105 to a UE 115. Downlink transmissions may also be called forward link transmissions while uplink transmissions may also be called reverse link transmissions.

The geographic coverage area 110 for a base station 105 may be divided into sectors making up a portion of the geographic coverage area 110, and each sector may be associated with a cell. For example, each base station 105 may provide communication coverage for a macro cell, a small cell, a hot spot, or other types of cells, or various combinations thereof. In some examples, a base station 105 may be movable and therefore provide communication coverage for a moving geographic coverage area 110. In some examples, different geographic coverage areas 110 associated with different technologies may overlap, and overlapping geographic coverage areas 110 associated with different technologies may be supported by the same base station 105 or by different base stations 105. The wireless communications system 100 may include, for example, a heterogeneous LTE/LTE-A/LTE-A Pro or NR network in which different types of base stations 105 provide coverage for various geographic coverage areas 110.

UEs 115 may be dispersed throughout the wireless communications system 100, and each UE 115 may be stationary or mobile. A UE 115 may also be referred to as a mobile device, a wireless device, a remote device, a handheld device, or a subscriber device, or some other suitable terminology, where the "device" may also be referred to as a unit, a station, a terminal, or a client. A UE 115 may also be a personal electronic device such as a cellular phone, a personal digital assistant (PDA), a tablet computer, a laptop computer, or a personal computer. In examples of this disclosure, a UE 115 may be any of the audio sources described in this disclosure, including a VR headset, an XR headset, an AR headset, a vehicle, a smartphone, a microphone, an array of microphones, or any other device including a microphone or is able to transmit a captured and/or synthesized audio stream. In some examples, an synthesized audio stream may be an audio stream that that was stored in memory or was previously created or synthesized. In some examples, a UE 115 may also refer to a wireless local loop (WLL) station, an Internet of Things (IoT) device, an Internet of Everything (IoE) device, or an MTC device, or the like, which may be implemented in various articles such as appliances, vehicles, meters, or the like.

Some UEs 115, such as MTC or IoT devices, may be low cost or low complexity devices, and may provide for automated communication between machines (e.g., via Machine-to-Machine (M2M) communication). M2M communication or MTC may refer to data communication technologies that allow devices to communicate with one another or a base station 105 without human intervention. In some examples, M2M communication or MTC may include communications from devices that exchange and/or use audio metadata indicating privacy restrictions and/or password-based privacy data to toggle, mask, and/or null various audio streams and/or audio sources as will be described in more detail below.

In some cases, a UE 115 may also be able to communicate directly with other UEs 115 (e.g., using a peer-to-peer (P2P) or device-to-device (D2D) protocol). One or more of a group of UEs 115 utilizing D2D communications may be within the geographic coverage area 110 of a base station 105. Other UEs 115 in such a group may be outside the geographic coverage area 110 of a base station 105, or be otherwise unable to receive transmissions from a base station 105. In some cases, groups of UEs 115 communicating via D2D communications may utilize a one-to-many (1:M) system in which each UE 115 transmits to every other UE 115 in the group. In some cases, a base station 105 facilitates the scheduling of resources for D2D communications. In other cases, D2D communications are carried out between UEs 115 without the involvement of a base station 105.

Base stations 105 may communicate with the core network 130 and with one another. For example, base stations 105 may interface with the core network 130 through backhaul links 132 (e.g., via an S1, N2, N3, or other interface). Base stations 105 may communicate with one another over backhaul links 134 (e.g., via an X2, Xn, or other interface) either directly (e.g., directly between base stations 105) or indirectly (e.g., via core network 130).

In some cases, wireless communications system 100 may utilize both licensed and unlicensed radio frequency spectrum bands. For example, wireless communications system 100 may employ License Assisted Access (LAA), LTE-Unlicensed (LTE-U) radio access technology, or NR technology in an unlicensed band such as the 5 GHz ISM band. When operating in unlicensed radio frequency spectrum bands, wireless devices such as base stations 105 and UEs 115 may employ listen-before-talk (LBT) procedures to ensure a frequency channel is clear before transmitting data. In some cases, operations in unlicensed bands may be based on a carrier aggregation configuration in conjunction with component carriers operating in a licensed band (e.g., LAA). Operations in unlicensed spectrum may include downlink transmissions, uplink transmissions, peer-to-peer transmissions, or a combination of these. Duplexing in unlicensed spectrum may be based on frequency division duplexing (FDD), time division duplexing (TDD), or a combination of both.

In this respect, various aspects of the techniques are described that enable one or more of the following examples:

Example 1. A device configured to process one or more audio streams, the device comprising: a memory configured to store the one or more audio streams; and a processor coupled to the memory, and configured to: obtain one or more microphone locations, each of the one or more microphone locations identifying a location of a respective one or more microphones that captured each of the corresponding one or more audio streams; obtain a listener location identifying a location of a listener; perform interpolation, based on the one or more microphone locations and the listener location, with respect to the audio streams to obtain an interpolated audio stream; obtain, based on the interpolated audio stream, one or more speaker feeds; and output the one or more speaker feeds.

Example 2. The device of example 1, wherein the one or more processors are configured to: determine, based on the one or more microphone locations and the listener location, a weight for each of the audio streams; and obtain, based on the weight, the interpolated audio stream.

Example 3. The device of example 1, wherein the one or more processors are configured to: determine, based on the one or more microphone locations and the listener location, a weight for each of the audio streams; and multiply the weight by the corresponding one of the one or more audio streams to obtain one or more weighted audio stream; and obtain, based on the one or more weighted audio streams, the interpolated audio stream.

Example 4. The device of example 1, wherein the one or more processors are configured to: determine, based on the one or more microphone locations and the listener location, a weight for each of the audio streams; and multiply the weight by the corresponding one of the one or more audio streams to obtain one or more weighted audio stream; and add the one or more weighted audio streams together to obtain the interpolated audio stream.

Example 5. The device of any combination of examples 2-4, wherein the one or more processors are configured to: determine a difference between each of the one or more microphone locations and the listener location; and determine, based on the difference between each of the one or more microphone locations and the listener location, the weight for each of the audio streams.

Example 6. The device of any combination of examples 2-5, wherein the one or more processors are configured to determine the weights for each audio frame of the one or more audio streams.

Example 7. The device of any combination of examples 1-6, wherein audio sources represented by the audio streams reside outside of the one or more microphones.

Example 8. The device of any combination of examples 1-7, wherein the one or more processors are configured to obtain, from a computer mediated reality device, the listener location.

Example 9. The device of example 8, wherein the computer mediated reality device comprises a head mounted display device.

Example 10. The device of any combination of examples 1-9, wherein the one or more processors are configured to obtain, from a bitstream that includes the audio streams, audio metadata that identifies the one or more microphone locations.

Example 11. The device of any combination of examples 1-10, wherein at least one of the one or more microphone locations changes to reflect movement of the corresponding one of the one or more microphones.

Example 12. The device of any combination of examples 1-11, wherein the one or more audio streams include a ambisonic audio stream (including higher order, mixed order, first order, second order), and wherein the interpolated audio stream includes an interpolated ambisonic audio stream (including higher order, mixed order, first order, second order).

Example 13. The device of any combination of claims 1-11, wherein the one or more audio streams include an ambisonic audio stream, and wherein the interpolated audio stream includes an interpolated ambisonic audio stream.

Example 14. The device of any combination of examples 1-13, wherein the listener location changes based on navigational commands issued by the listener.

Example 15. The device of any combination of examples 1-14, wherein the one or more processors are configured to receive audio metadata specifying the microphone locations, each of the microphone locations identifying a location of a cluster of microphones that captured the corresponding one or more audio streams.

Example 16. The device of any combination of examples 15, wherein the cluster of microphones are each positioned at a distance from one another that is greater than five feet.

Example 17. The device of any combination of examples 1-14, wherein the microphones are each positioned at a distance greater than five feet from one another.

Example 18. A method for processing one or more audio streams, the method comprising: obtaining one or more microphone locations, each of the one or more microphone locations identifying a location of a respective one or more microphones that captured each of the corresponding one or more audio streams; obtaining a listener location identifying a location of a listener; performing interpolation, based on the one or more microphone locations and the listener location, with respect to the audio streams to obtain an interpolated audio stream; obtaining, based on the interpolated audio stream, one or more speaker feeds; and outputting the one or more speaker feeds.

Example 19. The method of example 18, wherein performing the interpolation comprises: determining, based on the one or more microphone locations and the listener location, a weight for each of the audio streams; and obtaining, based on the weight, the interpolated audio stream.

Example 20. The method of example 18, wherein performing the interpolation comprises: determining, based on the one or more microphone locations and the listener location, a weight for each of the audio streams; multiplying the weight by the corresponding one of the one or more audio streams to obtain one or more weighted audio stream; and obtaining, based on the one or more weighted audio streams, the interpolated audio stream.

Example 21. The method of example 18, wherein performing the interpolation comprises: determining, based on the one or more microphone locations and the listener location, a weight for each of the audio streams; and multiplying the weight by the corresponding one of the one or more audio streams to obtain one or more weighted audio stream; and adding the one or more weighted audio streams together to obtain the interpolated audio stream.

Example 22. The method of any combination of example 19-21, wherein determining the weights comprises: determining a difference between each of the one or more microphone locations and the listener location; and determining, based on the difference between each of the one or more microphone locations and the listener location, the weight for each of the audio streams.

Example 23. The method of any combination of example 19-22, wherein determining the weights comprises determining the weights for each audio frame of the one or more audio streams.

Example 24. The method of any combination of examples 18-23, wherein audio sources represented by the audio streams reside outside of the one or more microphones.

Example 25. The method of any combination of examples 18-24, wherein obtaining the listener location comprises obtaining, from a computer mediated reality device, the listener location.

Example 26. The method of example 25, wherein the computer mediated reality device comprises a head mounted display device.

Example 27. The method of any combination of examples 18-26, wherein obtaining the one or more microphone locations comprises obtaining, from a bitstream that includes the audio streams, audio metadata that identifies the one or more microphone locations.

Example 28. The method of any combination of examples 18-27, wherein at least one of the one or more microphone locations changes to reflect movement of the corresponding one of the one or more microphones.

Example 29. The method of any combination of examples 18-28, wherein the one or more audio streams include a ambisonic audio stream (including higher order, mixed order, first order, second order), and wherein the interpolated audio stream includes an interpolated ambisonic audio stream (including higher order, mixed order, first order, second order).

Example 30. The method of any combination of examples 18-28, wherein the one or more audio streams include an ambisonic audio stream, and wherein the interpolated audio stream includes an interpolated ambisonic audio stream.

Example 31. The method of any combination of examples 18-30, wherein the listener location changes based on navigational commands issued by the listener.

Example 32. The method of any combination of examples 18-31, wherein obtaining the microphone locations comprises receiving audio metadata specifying the microphone locations, each of the microphone locations identifying a location of a cluster of microphones that captured the corresponding one or more audio streams.

Example 33. The method of example 32, wherein the cluster of microphones are each positioned at a distance from one another that is greater than five feet.

Example 34. The method of any combination of examples 18-31, wherein the microphones are each positioned at a distance greater than five feet from one another.

Example 35. A device configured to process one or more audio streams, the device comprising: means for obtaining one or more microphone locations, each of the one or more microphone locations identifying a location of a respective one or more microphones that captured each of the corresponding one or more audio streams; means for obtaining a listener location identifying a location of a listener; means for performing interpolation, based on the one or more microphone locations and the listener location, with respect to the audio streams to obtain an interpolated audio stream; means for obtaining, based on the interpolated audio stream, one or more speaker feeds; and means for outputting the one or more speaker feeds.

Example 36. The device of example 35, wherein the means for performing the interpolation comprises: means for determining, based on the one or more microphone locations and the listener location, a weight for each of the audio streams; and means for obtaining, based on the weight, the interpolated audio stream.

Example 37. The device of example 35, wherein the means for performing the interpolation comprises: means for determining, based on the one or more microphone locations and the listener location, a weight for each of the audio streams; means for multiplying the weight by the corresponding one of the one or more audio streams to obtain one or more weighted audio stream; and means for obtaining, based on the one or more weighted audio streams, the interpolated audio stream.

Example 38. The device of example 35, wherein the means for performing the interpolation comprises: means for determining, based on the one or more microphone locations and the listener location, a weight for each of the audio streams; means for multiplying the weight by the corresponding one of the one or more audio streams to obtain one or more weighted audio stream; and means for adding the one or more weighted audio streams together to obtain the interpolated audio stream.

Example 39. The device of any combination of examples 36-38, wherein the means for determining the weights comprises: means for determining a difference between each of the one or more microphone locations and the listener location; and means for determining, based on the difference between each of the one or more microphone locations and the listener location, the weight for each of the audio streams.

Example 40. The device of any combination of examples 36-39, wherein the means for determining the weights comprises means for determining the weights for each audio frame of the one or more audio streams.

Example 41. The device of any combination of examples 35-40, wherein audio sources represented by the audio streams reside outside of the one or more microphones.

Example 42. The device of any combination of examples 35-41, wherein the means for obtaining the listener location comprises means for obtaining, from a computer mediated reality device, the listener location.

Example 43. The device of example 42, wherein the computer mediated reality device comprises a head mounted display device.

Example 44. The device of any combination of examples 35-43, wherein the means for obtaining the one or more microphone locations comprises means for obtaining, from a bitstream that includes the audio streams, audio metadata that identifies the one or more microphone locations.

Example 45. The device of any combination of examples 35-44, wherein at least one of the one or more microphone locations changes to reflect movement of the corresponding one of the one or more microphones.

Example 46. The device of any combination of examples 35-45, wherein the one or more audio streams include a ambisonic audio stream (including higher order, mixed order, first order, second order), and wherein the interpolated audio stream includes an interpolated ambisonic audio stream (including higher order, mixed order, first order, second order).

Example 47. The device of any combination of examples 35-44, wherein the one or more audio streams include an ambisonic audio stream, and wherein the interpolated audio stream includes an interpolated ambisonic audio stream.

Example 48. The device of any combination of examples 35-47, wherein the listener location changes based on navigational commands issued by the listener.

Example 49. The device of any combination of examples 35-48, wherein the means for obtaining the microphone locations comprises means for receiving audio metadata specifying the microphone locations, each of the microphone locations identifying a location of a cluster of microphones that captured the corresponding one or more audio streams.

Example 50. The device of any combination of examples 49, wherein the cluster of microphones are each positioned at a distance from one another that is greater than five feet.

Example 51. The device of any combination of examples 35-48, wherein the microphones are each positioned at a distance greater than five feet from one another.

Example 52. A non-transitory computer-readable storage medium having stored thereon instructions that, when executed, cause one or more processors to: obtain one or more microphone locations, each of the one or more microphone locations identifying a location of a respective one or more microphones that captured each of the corresponding one or more audio streams; obtain a listener location identifying a location of a listener; perform interpolation, based on the one or more microphone locations and the listener location, with respect to the audio streams to obtain an interpolated audio stream; obtain, based on the interpolated audio stream, one or more speaker feeds; and output the one or more speaker feeds.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In some examples, the VR device (or the streaming device) may communicate, using a network interface coupled to a memory of the VR/streaming device, exchange messages to an external device, where the exchange messages are associated with the multiple available representations of the soundfield. In some examples, the VR device may receive, using an antenna coupled to the network interface, wireless signals including data packets, audio packets, video packets, or transport protocol data associated with the multiple available representations of the soundfield. In some examples, one or more microphone arrays may capture the soundfield.

In some examples, the multiple available representations of the soundfield stored to the memory device may include a plurality of object-based representations of the soundfield, higher order ambisonic representations of the soundfield, mixed order ambisonic representations of the soundfield, a combination of object-based representations of the soundfield with higher order ambisonic representations of the soundfield, a combination of object-based representations of the soundfield with mixed order ambisonic representations of the soundfield, or a combination of mixed order representations of the soundfield with higher order ambisonic representations of the soundfield.

In some examples, one or more of the soundfield representations of the multiple available representations of the soundfield may include at least one high-resolution region and at least one lower-resolution region, and wherein the selected presentation based on the steering angle provides a greater spatial precision with respect to the at least one high-resolution region and a lesser spatial precision with respect to the lower-resolution region.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, including fixed function processing circuitry and/or programmable processing circuitry, such as one or more digital signal processors (DSPs), general purpose microprocessors, application specific integrated circuits (ASICs), field programmable gate arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples have been described. These and other examples are within the scope of the following claims.

What is claimed is:

1. A device configured to process one or more audio streams, the device comprising:

one or more processors configured to:

obtain a current location of the device;

obtain a plurality of capture locations, each of the plurality of capture locations identifying a location at which a respective one of a plurality of audio streams is captured;

determine an angular position for each of the plurality of capture locations relative to the current location to obtain a plurality of angular positions;

select, based on the plurality of angular positions, a subset of the plurality of audio streams, the subset of the plurality of audio streams having less audio streams than the plurality of audio streams; and reproduce, based on the subset of the plurality of audio streams, a soundfield; and a memory coupled to the processor, and configured to store the subset of the plurality of audio streams.

2. The device of claim 1, wherein the one or more processors are configured to:

determine a distance between the current location and each of the plurality of capture locations to obtain a plurality of distances; and select, based on the plurality of distances and the plurality of angular positions, the subset of the plurality of audio streams.

3. The device of claim 2, wherein the one or more processors are configured to:

determine a total distance as a sum of the plurality of distances;

determine an inverse distance for each of the plurality of distances to obtain a plurality of inverse distances;

determine a ratio for each of the plurality of inverse distances as a corresponding one of the plurality of inverse distances divided by the total distance to obtain a plurality of ratios; and select, based on the plurality of ratios and the plurality of angular positions, the subset of the plurality of audio streams.

4. The device of claim 3, wherein the one or more processors are configured to assign, when one of the plurality of ratios exceeds a threshold, a corresponding one of the plurality of audio streams to the subset of the plurality of audio streams.

5. The device of claim 1, wherein the one or more processors are configured to:

determine a relative location between the current location and each of the plurality of capture locations to obtain a plurality of relative locations; and select, based on the plurality of relative locations and a threshold, and based on the plurality of angular positions, the subset of the plurality of audio streams.

6. The device of claim 1, wherein the current location is a first location captured at a first time;

wherein the subset of the plurality of audio streams is a first subset of the plurality of audio streams;

wherein the one or more processors are further configured to:

update the current location for a second time subsequent to the first time, the updated current location is a second location captured at the second time;

select, based on the updated current location and the plurality of locations, a second subset of the plurality of audio streams; and reproduce, based on the second subset of the plurality of audio streams, the soundfield.

7. The device of claim 1, wherein the one or more processors are configured to:

determine a variance of different subsets of the plurality of angular positions to obtain one or more variances; and assign, based on the one or more variances, corresponding audio streams of the plurality of audio streams to the subset of the plurality of audio streams.

8. The device of claim 1, wherein the one or more processors are configured to:

determine an entropy of different subsets of the plurality of angular positions to obtain one or more entropies; and assign, based on the one or more entropies, corresponding audio streams of the plurality of audio streams to the subset of the plurality of audio streams.

9. The device of claim 1, wherein the device includes one of a head mounted display, a virtual reality (VR) headset, an augmented reality (AR) headset, and a mixed reality (MR) headset.

10. A method of processing one or more audio streams, the method comprising:

obtaining a current location of a device;

obtaining a plurality of capture locations, each of the plurality of capture locations identifying a location at which a respective one of a plurality of audio streams is captured;

determining an angular position for each of the plurality of capture locations relative to the current location to obtain a plurality of angular positions;

selecting, based on the plurality of angular positions, a subset of the plurality of audio streams, the subset of the plurality of audio streams having less audio streams than the plurality of audio streams; and reproducing, based on the subset of the plurality of audio streams, a soundfield.

11. The method of claim 10, wherein selecting the subset of the plurality of audio streams comprises determining a distance between the current location and each of the plurality of capture locations to obtain a plurality of distances; and selecting, based on the plurality of distances and the plurality of angular positions, the subset of the plurality of audio streams.

12. The method of claim 11, wherein selecting the subset of the plurality of audio streams comprises:

determining a total distance as a sum of the plurality of distances;

determining an inverse distance for each of the plurality of distances to obtain a plurality of inverse distances;

determining a ratio for each of the plurality of inverse distances as a corresponding one of the plurality of inverse distances divided by the total distance to obtain a plurality of ratios; and selecting, based on the plurality of ratios and the plurality of angular positions, the subset of the plurality of audio streams.

13. The method of claim 12, wherein selecting the subset of the plurality of audio streams comprises assigning, when one of the plurality of ratios exceeds a threshold, a corresponding one of the plurality of audio streams to the subset of the plurality of audio streams.

14. The method of claim 10, wherein selecting the subset of the plurality of audio streams comprises:

determining a relative location between the current location and each of the plurality of capture locations to obtain a plurality of relative locations; and selecting, based on the plurality of relative locations and a threshold, and based on the plurality of angular positions, the subset of the plurality of audio streams.

15. The method of claim 10, wherein the current location is a first location captured at a first time;

wherein the subset of the plurality of audio streams is a first subset of the plurality of audio streams;

wherein the method further comprises:

updating the current location for a second time subsequent to the first time, the updated current location is a second location captured at the second time;

selecting, based on the updated current location and the plurality of locations, a second subset of the plurality of audio streams; and reproducing, based on the second subset of the plurality of audio streams, the soundfield.

16. The method of claim 10, wherein selecting the subset of the plurality of audio streams comprises:

determining a variance of different subsets of the plurality of angular positions to obtain one or more variances; and assigning, based on the one or more variances, corresponding audio streams of the plurality of audio streams to the subset of the plurality of audio streams.

17. The method of claim 10, wherein selecting the subset of the plurality of audio streams comprises:

determining an entropy of different subsets of the plurality of angular positions to obtain one or more entropies; and assigning, based on the one or more entropies, corresponding audio streams of the plurality of audio streams to the subset of the plurality of audio streams.

18. The method of claim 10, wherein the device includes one of a head mounted display, a virtual reality (VR) headset, an augmented reality (AR) headset, and a mixed reality (MR) headset.

19. A non-transitory computer-readable medium having stored thereon instructions that, when executed, cause one or more processors of a device to:

obtain a current location of the device;

obtain a plurality of capture locations, each of the plurality of capture locations identifying a location at which a respective one of a plurality of audio streams is captured;

determine an angular position for each of the plurality of capture locations relative to the current location to obtain a plurality of angular positions:

select, based on the plurality of angular positions, a subset of the plurality of audio streams, the subset of the plurality of audio streams having less audio streams than the plurality of audio streams; and reproduce, based on the subset of the plurality of audio streams, a soundfield.

20. A device configured to process one or more audio streams, the device comprising:

means for obtaining a current location of a device;

means for obtaining a plurality of capture locations, each of the plurality of capture locations identifying a location at which a respective one of a plurality of audio streams is captured;

means for determining an angular position for each of the plurality of capture locations relative to the current location to obtain a plurality of angular positions;

means for selecting, based on the plurality of angular positions, a subset of the plurality of audio streams, the subset of the plurality of audio streams having less audio streams than the plurality of audio streams; and means for reproducing, based on the subset of the plurality of audio streams, a soundfield.

* * * * *